US006334916B1

(12) United States Patent
Matsumoto et al.

(10) Patent No.: US 6,334,916 B1
(45) Date of Patent: Jan. 1, 2002

(54) A1-MG-SI BASED ALLOY SHEET

(75) Inventors: Katsushi Matsumoto; Yasuaki Sugizaki, both of Kobe; Masahiro Yanagawa, Tokyo; Yuichi Seki, Kobe, all of (JP)

(73) Assignee: Kobe Steel Ltd., Kobe (JP)

( * ) Notice: Subject to any disclaimer, the term of this patent is extended or adjusted under 35 U.S.C. 154(b) by 0 days.

(21) Appl. No.: 09/569,043

(22) Filed: May 10, 2000

Related U.S. Application Data

(63) Continuation of application No. PCT/JP99/04886, filed on Sep. 9, 1999.

(30) Foreign Application Priority Data

Sep. 10, 1998 (JP) ..... 10-257297
Mar. 5, 1999 (JP) ..... 11-059210

(51) Int. Cl.[7] ..... C22C 21/08
(52) U.S. Cl. ..... 148/437; 148/440
(58) Field of Search ..... 148/437, 440, 148/415, 416, 417, 418

(56) References Cited

U.S. PATENT DOCUMENTS 5,516,374 A * 5/1996 Habu et al. ..... 148/552
5,580,402 A * 12/1996 Fujita et al. ..... 148/417
6,117,252 A * 9/2000 Barlat et al. ..... 148/439

FOREIGN PATENT DOCUMENTS

JP 5-263203 10/1993
JP 5-295475 11/1993
JP 5-295476 11/1993
JP 7-150282 6/1995
JP 8-325663 12/1996
JP 8-325663 A * 12/1996
JP 11-189836 7/1999

OTHER PUBLICATIONS

Prediction of Forming Limit Diagrams of AL–Mg Rolled Sheets Taking Texture Into Account P. Ratchev, P. Van Houtte, B. Verlinden, P. De Smet, P. Neutjens, R. Baartman and P. Drent Textures and Microstructures, 1994, vol. 22, pp. 219–231.

* cited by examiner

*Primary Examiner*—George Wyszomierski
*Assistant Examiner*—Janelle Combs-Morillo
(74) *Attorney, Agent, or Firm*—Oblon, Spivak, McClelland, Maier & Neustadt, P.C.

(57) ABSTRACT

The present invention provides an Al—Mg—Si based alloy sheet whose press-formability (particularly, deep-drawing formability, stretch-formability and bendability) is made higher than conventional Al—Mg—Si based alloy sheets of JIS 6000 series. For texture of the Al—Mg—Si based alloy sheet, orientation density of at least Cube orientation is controlled in accordance with a sort of press forming, so that press-formability improved to match with the press forming is provided. For example, to improve deep-drawing formability of an Al—Mg—Si based alloy sheet, the ratio of orientation density of Goss orientation to the orientation density of the Cube orientation (Goss/Cube) is set to 0.3 or less, and a grain size is set to 80 $\mu$m or less.

20 Claims, 2 Drawing Sheets

A1-MG-SI BASED ALLOY SHEET

This application is a Con of PCT/JP99/04886 filed Sep. 9, 1999.

TECHNICAL FIELD

1. Field of the Invention

The present invention relates to an Al—Mg—Si based alloy sheet that is a metal sheet suitable for an automobile body panel or the like, and that generally belongs to JIS 6000 series, and relates to an Al—Mg—Si based alloy sheet as a material suitable for an engine hood or trunk hood of an automobile, or the like, for which press-formability and in particular stretch-formability and bendability are required, or suitable for an automobile door, a fender or the like, for which deep-drawing formability is required.

2. Description of the Background

Hitherto, cold rolled steel sheets have been used as automobile panel materials. Recently, however, the use of Al alloy sheets has been increasing as the demand that automobile bodies are made lighter has been enlarging to reduce exhaust gas and cut down fuel expense. Aluminum materials that are equal to steel sheets in strength have been known. However, such aluminum materials are in general poor in press-formability such as deep-drawing formability or stretch-formability. Thus, an improvement in press-formability has been strongly demanded. Hitherto, Al—Mg based alloys have been mainly used as aluminum alloy sheets excellent in formability. They are poor in baking hardenability of paint and stretcher strain marks are liable to be produced when they are subjected to press forming. In recent years, therefore, attention has been paid to Al—Mg—Si based alloys of JIS 6000 series. Thus, Al—Mg—Si based alloys as follows have come to be applied to automobile body panels: a 6009 alloy, a 6010 alloy and an alloy disclosed in Japanese Published Unexamined Patent Application No. 5-295475.

Recently, it has been suggested that formability is improved by controlling structure such as texture of sheet materials and a grain size. For example, Japanese Published Unexamined Patent Application No. 5-29547 suggests an Al—Mg—Si based alloy sheet in which deep-drawing formability is improved by optimizing its texture and grain size. Japanese Published Unexamined Patent Application No. 8-325663 suggests an Al—Mg—Si based alloy sheet excellent in press-formability wherein the ratios of respective orientation components are controlled.

However, it cannot be said that these Al—Mg—Si based alloy sheets have sufficient formability. Thus, automobile makers demand a further improvement in formability.

SUMMARY OF THE INVENTION

In the light of such a situation, the present invention has been made. An object thereof is to provide an Al—Mg—Si based alloy sheet whose press-formability (particularly, deep-drawing formability, stretch-formability and bendability) is made higher than conventional Al—Mg—Si based alloy sheets of JIS 6000 series.

DETAILED DESCRIPTION OF THE PREFERRED EMBODIMENTS

Figure 1:
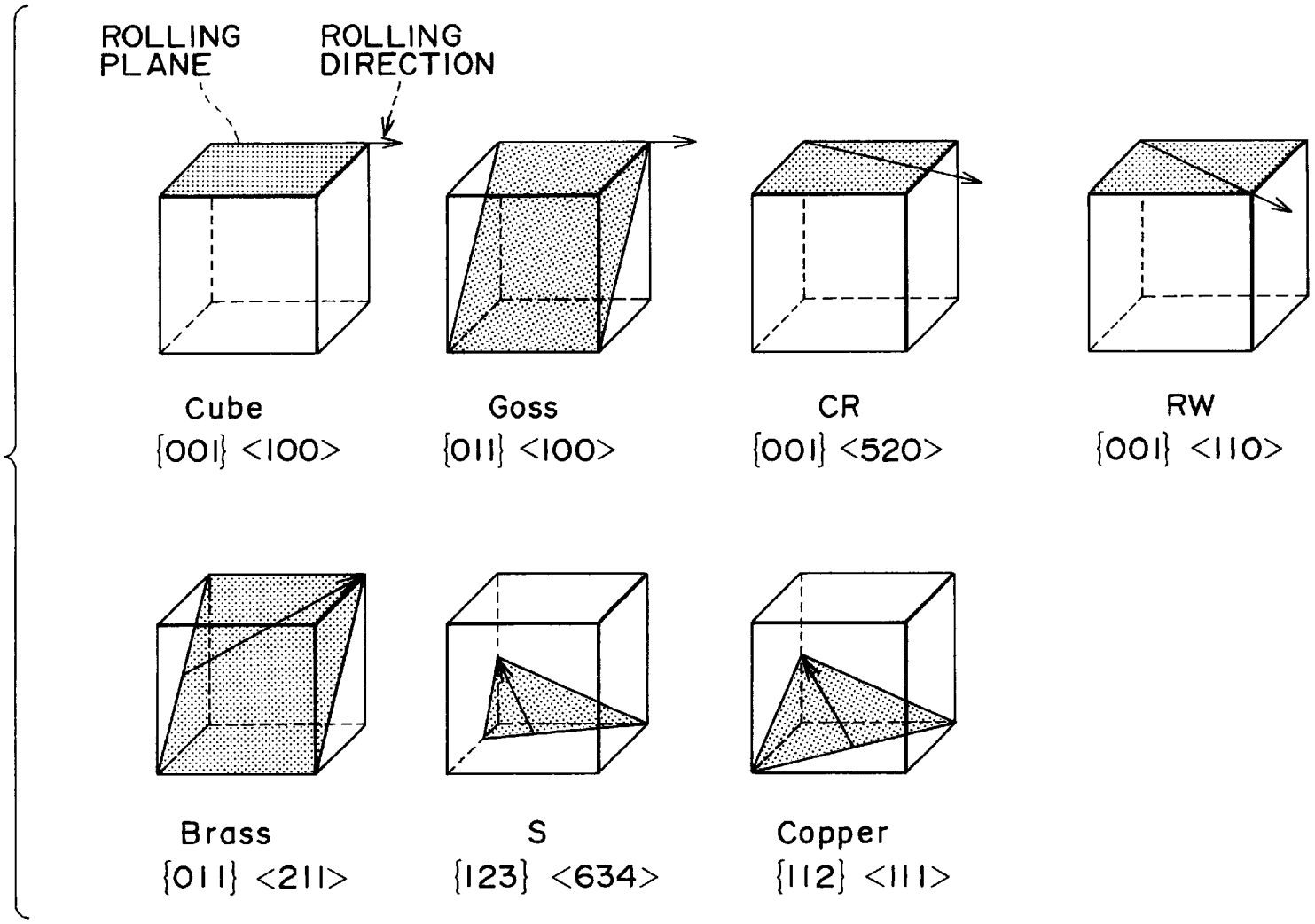
FIG. 1 provides a view illustrating the orientation components of texture.

The Al—Mg—Si based alloy sheet of the present invention that has overcome the above-mentioned problems has the subject matter that concerning texture of the Al—Mg—Si based alloy sheet, orientation density of at least Cube orientation component is controlled in accordance with a sort of press forming, so that press-formability improved to match with the press forming is provided.

Specific examples thereof include ① an Al—Mg—Si based alloy sheet, wherein the ratio of orientation on density of S orientation component to orientation density of Cube orientation component (S/Cube) is set to 1 or more, the ratio of orientation density of Goss orientation component to the orientation density of the Cube orientation component (Goss/Cube) is set to 0.3 or less, and a grain size is set to 80 μm or less, thereby improving deep-drawing formability; ② an Al—Mg—Si based alloy sheet, having texture wherein $X_1$ obtained by the following equation is 0 or more to improve stretch-formability, when Cube orientation density, RW orientation density, CR orientation density, Brass orientation density, Goss orientation density, PP orientation density, C orientation density, and S orientation density are represented by [Cube], [RW], [CR], [Brass], [Goss], [PP], [C] and [S], respectively; and ③ an Al—Mg—Si based alloy sheet, having texture wherein Y obtained by the following equation is 11 or less to improve press bendability.

$$X_1=0.02[\text{Cube}]-1.8[\text{RW}]+1.05[\text{CR}]-2.84[\text{Brass}]-0.22[\text{Goss}]-0.76[\text{PP}]-0.32[\text{C}]-1.49[\text{S}]+5.2$$

$$Y=0.66[\text{Cube}]-1.98[\text{RW}]+2.26[\text{CR}]+4.48[\text{Brass}]-1.36[\text{Goss}]-1.17[\text{PP}]+1.67[\text{C}]+0.07[\text{S}]$$

In the Al—Mg—Si based alloy ② or ③, its grain size is preferably 80 μm or less.

By controlling texture of an Al—Mg—Si based alloy sheet to set $X_2$ obtained by the following equation to 0 or more, an Al—Mg—Si based alloy having excellent stretch-formability can be obtained:

$$X_2=0.38[\text{Cube}]+0.76[\text{CR}]-1.97[\text{RW}]-0.42[\text{Goss}]-1.50.$$

If Cube orientation density is controlled to be within a range from 5 to 15 (both inclusive), an Al—Mg—Si based alloy sheet excellent in actual press-formability can be obtained. In this case, its average grain size is preferably 30 μm or less. The actual press-formability in the present invention means the property having both of stretch-formability and deep-drawing formability.

As components of an Al—Mg—Si based alloy suitable for the present invention, the following are desired: Mg: 0.1–2.0%, and Si: 0.1–2.0%. If the alloy sheet further comprises, as alloy components, one or more selected from the group consisting of the following in a total amount of 0.01–1.5%: Fe: 1.0% or less (not including 0%), Mn: 1.0% or less (not including 0%), Cr: 0.3% or less (not including 0%), Zr: 0.3% or less (not including 0%), V: 0.3% or less (not including 0%), and Ti: 0.1% or less (not including 0%), formability can be favorably improved.

If the alloy comprises one or more selected from the group consisting of the following in a total amount of 0.01–1.5%: Cu: 1.0% or less (not including 0%), Ag: 0.2% or less (not including 0%), and Zn: 1.0% or less (not including 0%), or comprises Sn: 0.2% or less (not including 0%), age hardening rate can be favorably be improved upon baking.

The inventors have been eagerly made eager experiments on the relationship between texture and press-formability of Al—Mg—Si based alloys. As a result, the inventors have found out that in rolled Al—Mg—Si based alloys texture is observed in various orientations, that the texture includes ones that are effective for an improvement in press-formability, ones that have a bad effect on the improvement, and ones that have no effect thereon, and that control of specific texture is very effective for the improvement in press-formability. Thus, the present invention has been made.

The texture of aluminum alloy sheets will be described. It is known that in the case of aluminum alloy sheets, Cube orientation, CR orientation, RW orientation, Goss orientation, Brass orientation, PP orientation, C orientation (Copper orientation), and S orientation develop and form texture (see FIG. 1). When the volume fraction of the texture changes, plastic anisotropy changes. The manner that the texture is produced varies in accordance with the processing method thereof even in the same crystal system. In the case of texture of rolled sheet materials, the above-mentioned manner is represented by normal direction to a rolling plane and a rolling direction. Normal direction to the rolling plane is represented by {A B C}, and the rolling direction is represented by <D E F> (A, B, C, D, E and F are integers). On the basis of such a representing manner, the respective orientation components are represented as follows.

| | |
|---|---|
| Cube orientation | {0 0 1} <1 0 0> |
| CR orientation | {0 0 1} <5 2 0> |
| RW orientation | {0 0 1} <1 1 0> |
| Goss orientation | {0 1 1} <1 0 0> |
| Brass orientation | {0 1 1} <2 1 1> |
| PP orientation | {0 1 1} <1 2 2> |
| C orientation | {1 1 2} <1 1 1> |
| S orientation | {1 2 3} <6 3 4> |

The orientation density of the above-mentioned texture is a value representing a ratio of each orientation intensity to randomly distributed orientation intensity. In the present invention, it is basically defined that deviations from such an orientation by ±10 degrees or less belong to the same orientation component. However, it is defined that about Brass orientation and PP orientation, deviations from each of these orientations by ±8 degrees or less belong to the same orientation component.

The texture of ordinary Al—Mg—Si based alloy sheets consist of these orientation components. When the constituting ratio of these components changes, the plastic anisotropy of the sheet materials changes so that the press-formability thereof is unstable in quality. However, by controlling at least the orientation density of Cube orientation in accordance with the sort of press forming, excellent press-formability can be attained. Specifically, it is preferred to control the texture correspondingly to stretch-formability, deep-drawing formability or press bendability.

To measure orientation distribution density, an ordinary X-ray diffraction method may be used to measure perfect or imperfect pole figures of at least three difference planes and obtain the density from the pole figures, using a crystalline orientation distribution function. Alternatively, the orientation distribution density may be obtained based on data obtained by the electron beam diffraction method, the SEM (Scanning Electron Microscopy)—ECP (Electron Channeling Pattern) method, the SEM-EBSP(Electron Back Scattered Pattern) method, or the like. Since the orientation distribution varies in the direction of thickens of a sheet, it is preferred that some points along the sheet thickness direction are arbitrarily selected to obtain the average value thereof; for example, surface of a sheet, the portion inside ¼ of thickness from the surface, and the central portion of the sheet along its thickness direction.

The following will describe relationships between the sort of press forming, and texture, grain sizes, alloy composition and manufacturing process conditions.

(1) Relationship Between Deep-drawing Formability and Texture

Excellent deep-drawing formability referred to herein means the matter that deep-drawing of a sheet at its flange is easy and the side portion of a punch is not easily ruptured when it is press-deformed with the punch.

The inventors fully made investigations on effect of respective texture components on deep-drawing formability. As a result, the inventors have found out that ① Cube orientation and Goss orientation, as texture, cause a drop in deep-drawing formability, ② S orientation causes an improvement in deep-drawing formability, and ③ effect of other orientations can be ignored.

Based on the findings ①–③, deep-drawing formability is greatly improved when the ratio of the orientation density in S orientation to the orientation density in Cube orientation (S/Cube) is 1 or more and the ratio of the orientation density in Goss orientation to the orientation density in Cube orientation (S/Cube) is 0.3 or less.

Moreover, it has been found that deep-drawing formability is especially greatly influenced by grain sizes and when the grain sizes exceed 80 μm, intergranular fracture or the like arises at the time of forming so that the formability deteriorates.

Therefore, Al—Mg—Si based alloy sheets excellent in deep-drawing formability have texture wherein the ratio of the orientation density in S orientation to the orientation density in Cube orientation (S/Cube) is 1 or more, the ratio of the orientation density in Goss orientation to the orientation density in Cube orientation (S/Cube) is 0.3 or less, and has a grain size of 80 μm or less. A preferred grain size is 60 μm or less.

(2) Relationship Between Stretch-formability and Texture (a) Excellent stretch-formability means the matter that cracking limit under biaxial stress is high. To satisfy this condition, there are three control factors. They are the matters that plastic anisotropy is weak, work hardenability is high, and strain rate sensitivity is a high value. It has been known since early times that a metal having weak texture is excellent in stretch-formability. However, when a sheet is produced by rolling, it is impossible to obtain a perfectly isotropic sheet (that is, weak texture). Some orientation becomes strong. The inventors evaluated the stretch-formability of Al—Mg—Si based alloy sheets wherein texture was variously changed, and fully examined effect of the respective texture components upon stretch-formability. As a result, the inventors have found out that stretch-formability can be satisfied in the case that the sheets have the texture wherein 0 or more is the value of $X_1$ represented by the following equation wherein Cube orientation density, RW orientation density, CR orientation density, Brass orientation density, Goss orientation density, PP orientation density, C orientation density, and S orientation density are represented by [Cube], [RW], [CR], [Brass], [Goss], [PP], [C] and [S], respectively.

$$X_1=0.02[\text{Cube}]-1.8[\text{RW}]+1.05[\text{CR}]-2.84[\text{Brass}]-0.22[\text{Goss}]-0.76[\text{PP}]-0.32[\text{C}]-1.49[\text{S}]+5.2$$

In order to make a further improvement in stretch-formability, the value of $X_1$ is preferably 1 or more, and is especially preferably 2 or more.

The grain size is preferably 80 μm or less. However, this is not an absolute condition about stretch-formability. Preferably, the upper limit of the grain sizes is 80 μm or less and particularly 60 μm or less from the standpoint of prevention of intergranular fracture.

(b) If it is possible to obtain such texture that the value of $X_2$ obtained by the following equation is 0 or more at the time when the Cube orientation density in the texture is represented by [Cube] and CR orientation density, RW orientation density and Goss orientation density are represented by [CR], [RW] and [Goss], respectively, Al—Mg—Si based alloy sheets can be obtained which are excellent in stretch-formability.

$$X_2=0.38[\text{Cube}]+0.76[\text{CR}]-1.97[\text{RW}]-0.42[\text{Goss}]-1.50$$

This equation has been introduced on the basis of a regression curve obtained based on many experimental data, and quantitatively shows the result that the texture in Cube orientation and CR orientation are very effective for an improvement in stretch-formability, the texture in RW orientation and Goss orientation have bad influence on stretch-formability, and the texture in the other orientations (for example, Brass orientation, S orientation and Copper orientation) do not have very great influence on stretch-formability.

(c) Upon actual press forming, not only stretch-formability but also deep-drawing formability factor are required. Specifically, on a stretch forming test, both ends of a rectangle test piece are clamped at a high pressure of, for example, 200 kN and grooves for preventing slide are formed in a clamping mould. Therefore, even if the test piece is subjected to stretch forming, both of the ends do not follow the form processing portion nor flow in. In actual press forming, however, slide between a clamping mould and a sheet material is caused and deep-drawing formability is also required. The inventors have found out that, upon repeated researches on the relationship between texture and press-formability, in order to make stretch-formability high, it is very effective to raise Cube orientation density while the rise in Cube orientation have a bad influence on stretch-formability (see FIG. 2). Accordingly, it is important in actual press forming to raise Cube orientation density within an appropriate range. That is, from the standpoint of improving stretch-formability, the lower limit of Cube orientation density is desirably 5, and is more desirably 8 or more. On the other hand, if Cube orientation density is too high, strength drops. Thus, the stretch-formability deteriorates (deep-drawing formability deteriorates) in the case that the sheet material flows in (slides), so that the upper limit of Cube orientation density is desirably 15 and more desirably 12 or less.

Figure 3:
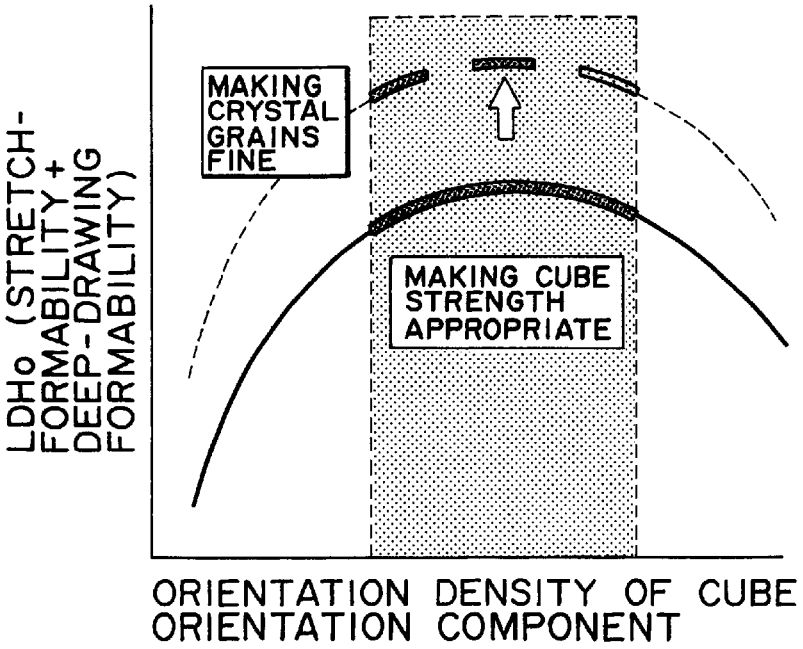
FIG. 3 illustrates the effect of making grain fine on actual press-formability.

Furthermore, actual press-formability simultaneously satisfying stretch-formability and deep-drawing formability is improved by strength raised by making the grains finer (see FIG. 3). The average grain size is desirably 30 μm or less, and is more desirably 25 μm or less.

(3) Relationship Between Press Bendability and Texture

Excellent press bendability means the matter that, upon pressing a metal under a load of a bending moment, a "burst" is unlikely to be generated in the outside of its curved portion.

Furthermore, the inventors evaluated the bendability of Al—Mg—Si based alloy sheets wherein their texture was variously changed, and fully made investigations on effect of the respective texture components upon bendability. As a result, the inventors have found out that bendability can be satisfied when the sheets have the texture wherein 11 or less is the value of Y represented by the following equation wherein Cube orientation density, RW orientation density, CR orientation density, Brass orientation density, Goss orientation density, PP orientation density, C orientation density, and S orientation density are represented by [Cube], [RW], [CR], [Brass], [Goss], [PP], [C] and [S], respectively.

$$Y=0.66[\text{Cube}]-1.98[\text{RW}]+2.26[\text{CR}]+4.48[\text{Brass}]-1.36[\text{Goss}]-1.17[\text{PP}]+1.67[\text{C}]+0.07[\text{S}]$$

In order to make a further improvement in bendability, it is preferred that the Y value is 10 or less.

The grain size is preferably 80 μm or less. However, this is not necessarily an absolute condition about press bendability in the same way as about stretch-formability. Preferably, the upper limit of the grain size is 80 μm or less and particularly 60 μm or less from the standpoint of prevention of intergranular fracture.

(4) About Chemical Composition

The Al—Mg—Si based alloys of the present invention generally belong to JIS 6000 series. If the conditions of the above-mentioned texture are satisfied, press-formability can be satisfied. Their alloy composition preferably satisfies the following numerical ranges in spite of the sort of press forming.

Mg: 0.1–2.0%

Si: 0.1–2.0%

Mg is a solid-solution strengthening element that contributes to an improvement in strength and ductility. Mg and Si form clusters or intermediate phases having the composition of $Mg_2Si$, which is called G. P. zone, and are elements that contribute to a rise in strength by baking. Each amount of Mg and Si needs to be 0.1% or more, and are desirably 0.4% or more. However, if each of the amounts of them is too large, strength deteriorates upon baking. Thus, each amount of Mg and Si should be 2.0% or less, and is desirably 1.5% or less.

Fe: 1.0% or less (not including 0%)

Mn: 1.0% or less (not including 0%)

Cr: 0.3% or less (not including 0%)

Zr: 0.3% or less (not including 0%)

V: 0.3% or less (not including 0%)

Ti: 0.1% or less (not including 0%)

These elements have an effect of making grains fine in the case that Al—Mg—Si based alloy sheets are produced by continuous cast process. Therefore, if one or more of these elements are added, it is possible that the intergranular fracture do not arise easily and it is possible that formability is made higher. These elements make precipitations during homogenizing treatment or hot rolling. These precipitations act as preferential nuclei-generating sites for recrystallization orientations and are effective for forming preferable texture. However, if each of the elements is incorporated over its upper limit, Al and the element make a coarse compound. The compound becomes a starting point of break so that, conversely, formability deteriorates. Thus, it is desired that each of the elements is added in an amount of the above-mentioned upper limit or less. More preferred amounts are as follows: Mn: 0.6% or less, Cr: 0.2% or less, Zr: 0.2% or less, V: 0.2% or less, and Ti: 0.05%. It is desired that the total amount of these elements is 0.01–1.5 (both inclusive).

In the present invention, a sheet material may be produced from an Al scrap material as a raw material from the viewpoint of effective use of resources and a drop in costs. In this case, Fe is inevitably contained in a large amount. Fe is an element for making Fe based precipitations α-AlFeSi, β-AlFeSi, $Al_2Fe$, $Al_2(Fe, Mn)$, $Al_{12}(Fe, Mn)_3Cu_{12}$, $Al_7Cu_2Fe$ etc.), exhibits effect of making grains fine and acts as preferential nuclei-generating sites for recrystallization orientations. If the amount of Fe is too small, the effect of making grains fine cannot be obtained and the formation of desired texture is blocked. Therefore, the amount is essentially 0.1% or more, and is desirably more than 0.3%. on the other hand, if the amount is too large, coarse precipitations are produced and they become starting points of crack. Besides, the formation of desired texture is blocked. As a result, formability deteriorates remarkably. Thus, the amount is essentially 1.5% or less, and is desirably 1.0% or less. According to the present invention, an Al scrap material as a raw material is used to obtain excellent stretch-formability even in Al—Mg—Si based alloy sheets whose Fe content is over 0.3% or Al—Mg—Si based alloy sheets whose Fe content is over 0.6%.

Cu: 1.0% or less (not including 0%)

Ag: 0.2% or less (not including 0%)

Zn: 1.0% or less (not including 0%)

These are elements for improving age hardening rate upon baking. Since the amounts thereof are over the upper limits, a coarse compound is formed so that formability deteriorates. Thus, they are desirably added in amounts of the upper limits or less. More preferred amounts are as follows: Cu: 0.6% or less, Ag: 0.1% or less, and Zr: 0.6% or less. The total mount of these elements is desirably 0.01–1.5% (both inclusive).

Sn: 0.2% or less (not including 0%)

Sn is an element for suppressing ageing at room temperature before baking and accelerating ageing upon the baking. If the amount thereof is too large, a coarse compound is formed so that formability deteriorates. Thus, the amount thereof is desirably 0.2% or less and is more preferably 0.1% or less.

(5) Texture and Manufacturing Process Conditions

The Al—Mg—Si based alloy sheet of the present invention is produced through casting, heat-treating for homogenization, hot rolling, cold rolling and final annealing steps. Since resultant texture changes by chemical composition and conditions set in respective steps, desired texture may be obtained by selecting overall conditions for a series of manufacturing process steps. Thus, manufacturing process conditions for the respective steps are not especially limited.

Specifically, the casting may be a casting process generally performed for Al based alloys, and is generally continues casting.

After the casting, a heat-treatment for homogenization is conducted. In the case that a transition element such as Mn, Cr, Fe, Zr or V is added, it is important to control precipitations into desired forms. These precipitations act as preferential nucleus-generating sites for recrystallization orientations and control what texture is formed. These precipitations control grain sizes to control the limit of forming-crack largely. Therefore, it is necessary to select appropriately optimal conditions for the heating-treatment for homogenization in accordance with the sort of transition metals such as Mn, Cr, Fe, Zr and V and added amounts thereof.

Optimal conditions for the hot rolling step and the cold rolling step performed after the heating-treatment for homogenization are changed by the form of the precipitations formed by the heating-treatment for homogenization. Preferably, therefore, they are appropriately selected. The temperature, the rolling reduction in the hot rolling and the cold rolling, and the combination thereof may be appropriately selected. In general, it is preferred that the hot rolling is performed at about 300–550° C., the cold rolling is performed at from room temperature to about 150° C., and the finishing pass rolling reduction in the respective rolling steps, and the final cold rolling reduction are about 10–95%. After the hot rolling and before the cold rolling, the alloy may make into a homogenous structure by rough annealing, that is, by annealing the structure that is not uniform and is generated upon the hot rolling in order to recrystallize the structure. Alternatively, intermediate annealing may be performed in the middle of the cold rolling. In the case that the rough annealing is performed or is not performed after the hot rolling, or in the case that the intermediate annealing is performed or is not performed, optimal rolling conditions are different. Thus, it is preferred to select rolling conditions correspondingly to the rough annealing or the intermediate annealing, and conditions for these annealing treatments. The finishing rolling reduction is a rolling reduction from the intermediate annealing to the final thickness in the case that the intermediate annealing is performed in the middle of the cold rolling step. It corresponds to the cold rolling reduction in the case that the intermediate annealing is not performed.

After the cold rolling, final heat-treatment (solution heat treatment) is conducted. In the solution heat treatment, rapid heating may be performed up to a treating temperature (which is not especially limited and is generally from 500 to 580° C.) in a single step, or may be performed by two-step heating wherein gradual heating is performed and subsequently rapid heating is performed up to the treating temperature. The time for keeping the treating temperature can be appropriately selected, too. The texture is also changed depending on the conditions for such a solution heat treatment. Whether water cooling or air cooling is performed after the solution heat treatment is appropriately selected in accordance with alloy composition, the rolling conditions, the conditions for the solution heat treatment, and the like.

As described above, optimum texture can be formed and press-formability can be greatly improved by synthetically controlling the conditions for the heat-treatment for homogenization, the rolling, the rough annealing, the solution heat treatment, and the like. Therefore, each of these producing conditions may overlap with conventional producing conditions. However, by performing a special combination as a series of producing steps, it is possible to obtain texture suitable for required formability.

A tendency is however as follows. When the final cold rolling reduction is a low value such as 30% or less, the texture excellent in deep-drawing formability can easily be obtained. When the final cold rolling reduction is about 50%, the texture excellent in stretch formability can easily be obtained. When the final cold rolling reduction is a high value such as 70% or more, the texture excellent inbendability can easily be obtained. For the texture excellent in deep-drawing formability, it is effective to perform an annealing in the middle of the cold rolling. The final cold rolling reduction is, in the case that an annealing is performed in the middle of the cold rolling, a rolling reduction after the annealing. In the case that any annealing is not performed in the middle thereof, the final cold rolling reduction is a cold rolling reduction.

The following will describe the present invention in more detail by way of Examples. However, the present invention is not limited to the following Examples. The technical scope of the present invention includes all modifications within the scope that does not depart from the subject matters described above and later.

First, methods for evaluation and measurement using the following Examples will be described.

[Method for Evaluation and Method for Measurement]

① Measurement of Texture

About the surface of a sheet which had been subjected to solution heat treatment, a portion inside ¼ of thickness from the surface, and the central portion of the sheet along its thickness direction, Cu was used as a target in an ordinary X-ray diffraction method, so as to measure (100), (110) and (111) perfect pole figures under conditions that a tube voltage was 50 kV and a tube current was 200 mA. Orientation densities of respective orientations in the respective faces were calculated from them, using a crystalline orientation distribution function. They were averaged to obtain the orientation density of the whole of the sheet material.

② Measurement of a Grain Size

A sectional face of a sheet in its longitudinal thickness direction was observed or photographed. The number of grains that were perfectly cut was counted with the aid of lines having known lengths and their cut lengths were averaged. The average value was defined as a grain size.

③ Deep-drawing Formability (A Square Pillar Drawing Test)

The periphery of a square sheet material having a thickness of 1 mm and each side of 90 mm in length was strongly pressed and the sheet material was subjected to deep-drawing with a square pillar type punch having each side of 40 mm in length until the sheet material cracked. The deep-drawing height (mm) when the sheet material cracked was measured. As the drawing height is higher, it is shown that deep-drawing formability is better. Any drawing height of 13.3 mm or more satisfies demand.

In the deep-drawing, a mineral oil was used as a lubricant.

④ Stretch-formability (A $LDH_0$ Test)

A sheet material of 1 mm in thickness was cut into test pieces 180 mm long and 110 mm wide. A spherical bulging punch and R-303P as a lubricant were used to stretch-form the test piece at a fold-pressing pressure of 200 kN and a punch speed of 4 mm/s. The height (mm) when the test piece cracked was obtained. As the crack limit height is large, it is meant that stretch-formability is better. In order to satisfy required stretch-formability, the height is essentially over 27.5 mm and is preferably 29 mm or more.

⑤ Bendability (180° Contact Bending Test)

In the bending test defined in JIS Z2248, a sheet was subjected to 180° bending contact. It was judged with eyes whether or not any "burst" was in the outside of a curved portion. The case that no "burst" was recognized was evaluated as good, and the case that a burst was recognized was evaluated as bad.

On the basis of specific Examples, the following will describe Al—Mg—Si based alloys in which, in particular, deep-drawing formability was improved, Al—Mg—Si based alloys in which stretch-formability was improved, and Al—Mg—Si based alloys in which bendability was improved, among Al—Mg—Si based alloys in which press-formability was improved. The Al—Mg—Si based alloy of the present invention is not however limited to the following Examples.

In tables shown below, the indication (A:B) in columns of heat-treatment for homogenization and intermediate annealing shows holding condition at A° C. for B hours. [Al—Mg—Si based alloy excellent in deep-drawing formability]

EXAMPLE 1

Sheet materials of 500 mm in thickness were produced by casting, using Al—0.6%Mg—1.2%Si alloys (hereinafter referred to as "base alloy" in the present Example, and F1, F2, F9 and F10 in Table 1 correspond thereto), Al—0.6%Mg—1.2%Si—0.2%Mn alloys (hereinafter referred to as "Mn-added alloy" in the present Example, and F3–5 and F11–13 in Table 1 correspond thereto), and Al—0.6%Mg—1.2%Si—0.2%Fe alloys (hereinafter referred to as "Fe-added alloy" in the present Example, and F6–8 and F14–16 in Table 1 correspond thereto) They were subjected to heat-treatment for homogenization shown in Table 1.

From the temperature for the heat-treatment for homogenization, the sheets were subjected to rough hot rolling to prepare sheet materials of 30 mm thickness, and subsequently subjected to finishing hot rolling to prepare sheet materials of 5 mm in thickness. The finishing pass rolling reduction in the rough rolling was set to 70%. The starting temperature for the finishing rolling was as shown in FIG. 1. The sheets were subjected to rough annealing (held at 480° C. for 2 minutes) followed by cold rolling, to obtain sheet materials of 1 mm in thickness. By changing the position of intermediate annealing performed in the cold rolling, final cold rolling reductions were changed. The final cold rolling reduction means that a rolling reduction from the thickness at the time of performing the intermediate annealing to a thickness of 1 mm, which is finally obtained. The sheet materials of 1 mm in thickness that were obtained by the cold rolling were subjected to solution heat treatment.

In the above-mentioned consecutive producing steps, conditions for the homogenizing treatment, finishing rolling starting temperature, final cold rolling reduction, conditions for the intermediate annealing and conditions for the solution heat treatment were changed as shown inn Table 1, to obtain F1–F16 materials wherein texture and grain sizes varied.

About the texture, respective orientation densities of Cube orientation, RW orientation, CR orientation, Brass orientation, Goss orientation, PP orientation, C orientation and S orientation were measured to calculate the ratio of S orientation density to Cube orientation density, which was concerned with deep-drawing formability, (S/Cube) and the ratio of Goss orientation to Cube orientation (Goss/Cube). The resultant F1–F16 materials were subjected to a square pillar drawing test.

The test results are shown in Table 1, together with alloy composition, manufacturing process conditions, texture and grain sizes.

TABLE 1

| | Alloy composition (%) | | | | | Manufacturing process conditions | | | | | Texture | | Grain size | Drawing height |
|---|---|---|---|---|---|---|---|---|---|---|---|---|---|---|
| No. | Mg | Si | Mn | Fe | Al | Homogenizing treatment | Finishing start (° C.) | Intermediate annealing | Final cold rolling reduction (%) | Solution heat treatment | S/Cube | Goss/Cube | (μm) | (mm) |
| F1 | 0.6 | 1.2 | 0 | 0 | balance | 550:4 h | 400 | 200:1 h | 17 | 550:30 s | 1.5 | 0.1 | 65 | 13.8 |
| F2 | 0.6 | 1.2 | 0 | 0 | balance | 550:4 h | 400 | 200:1 h | 30 | 550:30 s | 1.2 | 0.2 | 52 | 13.5 |
| F3 | 0.6 | 1.2 | 0.2 | 0 | balance | 555:24 h | 410 | 200:1 h | 10 | 550:30 s | 2.2 | 0.2 | 51 | 13.8 |
| F4 | 0.6 | 1.2 | 0.2 | 0 | balance | 555:24 h | 410 | 400:1 h | 17 | 550:30 s | 1.0 | 0.3 | 38 | 13.4 |
| F5 | 0.6 | 1.2 | 0.2 | 0 | balance | 555:24 h | 410 | 200:1 h | 30 | 550:30 s | 1.0 | 0.2 | 49 | 13.5 |
| F6 | 0.6 | 1.2 | 0 | 0.2 | balance | 560:18 h | 415 | 200:1 h | 17 | 550:30 s | 2.1 | 0.2 | 56 | 13.7 |
| F7 | 0.6 | 1.2 | 0 | 0.2 | balance | 560:18 h | 415 | 200:1 h | 30 | 550:30 s | 1.8 | 0.1 | 57 | 13.7 |
| F8 | 0.6 | 1.2 | 0 | 0.2 | balance | 560:18 h | 415 | 400:1 h | 30 | 550:30 s | 1.0 | 0.3 | 46 | 13.4 |
| F9 | 0.6 | 1.2 | 0 | 0 | balance | 550:4 h | 400 | 200:1 h | 50 | 550:30 s | 0.9 | 0.3 | 42 | 13.2 |
| F10 | 0.6 | 1.2 | 0 | 0 | balance | 550:4 h | 400 | 200:1 h | 8 | 550:30 s | 0.5 | 0.5 | 30 | 12.9 |
| F11 | 0.6 | 1.2 | 0.2 | 0 | balance | 555:24 h | 410 | 200:1 h | 9 | 550:1 h | 1.1 | 0.2 | 98 | 13.1 |
| F12 | 0.6 | 1.2 | 0.2 | 0 | balance | 555:24 h | 410 | 200:1 h | 50 | 550:30 s | 1.0 | 0.4 | 49 | 13.0 |
| F13 | 0.6 | 1.2 | 0.2 | 0 | balance | 555:24 h | 410 | 200:1 h | 70 | 550:30 s | 0.7 | 0.5 | 47 | 12.7 |
| F14 | 0.6 | 1.2 | 0 | 0.2 | balance | 560:18 h | 415 | 400:1 h | 5 | 550:30 s | 1.2 | 0.2 | 140 | 13.1 |
| F15 | 0.6 | 1.2 | 0 | 0.2 | balance | 560:18 h | 415 | 200:1 h | 35 | 550:1 h | 1.0 | 0.3 | 120 | 13.0 |
| F16 | 0.6 | 1.2 | 0 | 0.2 | balance | 560:18 h | 415 | 200:1 h | 70 | 550:30 s | 0.4 | 0.6 | 63 | 12.5 |

As shown from Table 1, in the alloys (F9, 10, 12,13,15 and 16) wherein the S/Cube was less than 1.0 or the Goss/Cube was over 0.3, their drawing heights were less than 13.4 mm. In the alloy (F11) wherein the S/Cube was less than 1.0 or the Goss/Cube was over 0.3 but its grain size was over 80 μm, its drawing height was less than 13.4 mm. This did not satisfy deep-drawing formability. On the otherhand, in the alloys (F1–8) wherein the S/Cube was 1.0 or more, the Goss/Cube was 0.3 or less and their grain sizes were 80 μm or less, their drawing heights were 13.4 mm or more. They satisfied deep-drawing formability.

EXAMPLE 2

Figure 2:
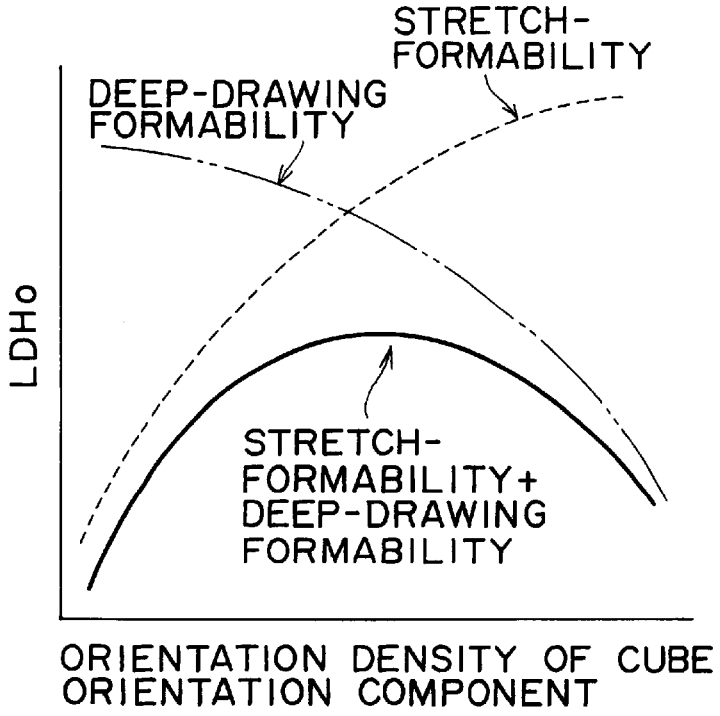
FIG. 2 illustrates the relationship between cube orientation density and actual press-formability.

The same manner as in Example 1 was performed except that, about Al—Mg—Si based alloys having compositions shown in FIG. 2 (Al—Mg—Si based alloys F21 and 31, and Al—Mg—Si based alloys F22–30 and 32–38, which comprised at least one of Mn, Fe, Cr, Zr, V and Ti), manufacturing process conditions (conditions for the homogenizing treatment, finishing hot rolling starting temperature, conditions for the intermediate annealing, final cold rolling reductions, and conditions for the solution heat treatment) were changed as shown in Table 2. Thus, alloy sheets F21–38 having texture and grain sizes as shown in Table 2 were obtained.

The resultant alloy sheets were subjected to a square pillar test.

The test results are shown in Table 2, together with alloy composition, manufacturing process conditions, texture and grain sizes.

TABLE 2

| | Alloy composition (%) | | | | | | | | | Manufacturing process conditions | | | | | Texture | | Grain | Drawing |
|---|---|---|---|---|---|---|---|---|---|---|---|---|---|---|---|---|---|---|
| No. | Mg | Si | Mn | Fe | Cr | Zr | V | Ti | Al | Homogenizing treatment | Finishing start (° C.) | Intermediate annealing | Final cold rolling reduction (%) | Solution heat treatment | S/Cube | Goss/Cube | size (μm) | height (mm) |
| F21 | 1.5 | 1.5 | 0.0 | 0.0 | 0.0 | 0.0 | 0.0 | 0.0 | balance | 550:8 h | 390 | 200:1 h | 17 | 30 s | 1.8 | 0.2 | 60 | 13.6 |
| F22 | 1.0 | 0.6 | 0.0 | 0.0 | 0.0 | 0.0 | 0.0 | 0.03 | balance | 530:8 h | 380 | 200:1 h | 17 | 30 s | 1.2 | 0.3 | 73 | 13.4 |
| F23 | 0.3 | 0.2 | 0.0 | 0.0 | 0.0 | 0.0 | 0.0 | 0.10 | balance | 535:24 h | 405 | 200:1 h | 30 | 30 s | 1.0 | 0.3 | 80 | 13.3 |
| F24 | 0.6 | 1.2 | 0.2 | 0.1 | 0.0 | 0.05 | 0.0 | 0.0 | balance | 560:24 h | 410 | 200:1 h | 17 | 30 s | 2.2 | 0.2 | 48 | 13.9 |
| F25 | 0.6 | 1.2 | 0.0 | 0.1 | 0.3 | 0.0 | 0.05 | 0.0 | balance | 555:16 h | 400 | 400:1 h | 17 | 30 s | 1.3 | 0.2 | 41 | 13.5 |
| F26 | 0.6 | 1.2 | 0.0 | 0.1 | 0.0 | 0.30 | 0.0 | 0.0 | balance | 550:12 h | 400 | 400:1 h | 17 | 30 s | 1.4 | 0.2 | 40 | 13.5 |
| F27 | 0.6 | 1.2 | 0.0 | 0.1 | 0.0 | 0.0 | 0.30 | 0.0 | balance | 560:24 h | 420 | 200:1 h | 30 | 30 s | 1.8 | 0.1 | 55 | 13.7 |
| F28 | 0.6 | 1.2 | 0.0 | 1.0 | 0.0 | 0.0 | 0.0 | 0.0 | balance | 550:8 h | 395 | 200:1 h | 17 | 30 s | 2.0 | 0.3 | 40 | 13.6 |
| F29 | 0.6 | 1.2 | 1.0 | 0.0 | 0.0 | 0.0 | 0.0 | 0.0 | balance | 555:24 h | 390 | 400:1 h | 30 | 30 s | 1.1 | 0.3 | 30 | 13.4 |
| F30 | 0.6 | 1.2 | 0.1 | 0.1 | 0.1 | 0.0 | 0.0 | 0.0 | balance | 545:24 h | 405 | 200:1 h | 17 | 30 s | 2.3 | 0.1 | 44 | 13.9 |
| F31 | 1.6 | 1.0 | 0.0 | 0.0 | 0.0 | 0.0 | 0.0 | 0.0 | balance | 550:4 h | 410 | 200:1 h | 17 | 30 s | 1.6 | 0.4 | 58 | 13.0 |
| F32 | 1.0 | 1.6 | 0.0 | 0.0 | 0.0 | 0.0 | 0.0 | 0.0 | balance | 550:4 h | 400 | 200:1 h | 17 | 30 s | 0.9 | 0.3 | 57 | 12.6 |
| F33 | 0.6 | 1.2 | 1.1 | 0.0 | 0.0 | 0.0 | 0.0 | 0.0 | balance | 550:4 h | 385 | 400:1 h | 30 | 30 s | 0.9 | 0.4 | 31 | 12.0 |
| F34 | 0.6 | 1.2 | 0.0 | 1.1 | 0.0 | 0.0 | 0.0 | 0.0 | balance | 550:4 h | 405 | 200:1 h | 17 | 30 s | 1.5 | 0.4 | 30 | 11.5 |
| F35 | 0.6 | 1.2 | 0.0 | 0.0 | 0.4 | 0.0 | 0.0 | 0.0 | balance | 550:4 h | 390 | 200:1 h | 17 | 30 s | 0.9 | 0.5 | 27 | 10.5 |
| F36 | 0.6 | 1.2 | 0.0 | 0.0 | 0.0 | 0.40 | 0.0 | 0.0 | balance | 550:4 h | 395 | 200:1 h | 17 | 30 s | 0.8 | 0.4 | 26 | 10.1 |
| F37 | 0.6 | 1.2 | 0.0 | 0.0 | 0.0 | 0.0 | 0.40 | 0.0 | balance | 550:4 h | 390 | 200:1 h | 17 | 30 s | 0.8 | 0.5 | 24 | 10.2 |
| F38 | 0.6 | 1.2 | 0.0 | 0.0 | 0.0 | 0.0 | 0.0 | 0.15 | balance | 550:4 h | 400 | 200:1 h | 17 | 30 s | 0.8 | 0.5 | 36 | 9.9 |

As shown from Table 2, the alloys (F21–30) comprising the composition having at least one of Mn, Fe, Cr, Zr, V and Ti within a given range, having a ratio of the S/Cube and a ratio of the Goss/Cube within ranges of the present invention, and having a grain size of 80 μm or less had a drawing height of 13.4 mm or more and were excellent in deep-drawing formability.

EXAMPLE 3

The same way as in Example 1 was performed except that manufacturing process conditions (conditions for the homogenizing treatment, finishing hot rolling starting temperature, conditions for the intermediate annealing, final cold rolling reduction, and conditions for the solution heat treatment) were changed as shown in Table 2 about Al—Mg—Si based alloys having the compositions shown in Table 3 (Al—Mg—Si based alloys comprising at least one of Mn, Fe, Cr, Zr, V and Ti and comprising a GP promoting element (at least one of Cu, Ag, Zn and Sn)). Thus, alloy sheets F41–55 having texture and grain sizes as shown in Table 3 were obtained.

The resultant alloy sheets were subjected to a cylindrical pillar drawing test.

The test results are shown in Table 3, together with the alloy compositions, the manufacturing process conditions, the texture and grain sizes.

TABLE 3

| | Alloy composition (%) | | | | | | | | | Manufacturing process conditions | | | | | Texture | | | |
|---|---|---|---|---|---|---|---|---|---|---|---|---|---|---|---|---|---|---|
| No. | Mg | Si | Mn | Fe | Cr | Zr | Ti, V | GP promoting element | Al | Homogenizing treatment | Finishing start (° C.) | Intermediate annealing | Final cold rolling reduction (%) | Solution heat treatment | S/Cube | Goss/Cube | Grain size (μm) | Drawing height (mm) |
| F41 | 0.6 | 1.2 | 0.2 | 0.1 | 0.0 | 0.0 | 0.0 | Cu:1.0 | balance | 530:12 h | 375 | 200:1 h | 17 | 30 s | 2.0 | 0.2 | 44 | 13.7 |
| F42 | 0.6 | 1.2 | 0.2 | 0.1 | 0.0 | 0.0 | 0.0 | Cu:0.5 | balance | 530:12 h | 380 | 200:1 h | 17 | 30 s | 2.0 | 0.1 | 47 | 13.5 |
| F43 | 0.6 | 1.2 | 0.0 | 0.1 | 0.0 | 0.1 | 0.0 | Ag:0.2 | balance | 550:24 h | 400 | 400:1 h | 17 | 30 s | 1.2 | 0.3 | 40 | 13.4 |
| F44 | 0.6 | 1.2 | 0.0 | 0.1 | 0.0 | 0.1 | 0.0 | Ag:0.1 | balance | 550:24 h | 390 | 400:1 h | 17 | 30 s | 1.2 | 0.3 | 40 | 13.4 |
| F45 | 0.8 | 1.0 | 0.1 | 0.0 | 0.1 | 0.0 | 0.0 | Zn:1.0 | balance | 545:8 h | 390 | 200:1 h | 30 | 30 s | 1.0 | 0.2 | 37 | 13.5 |
| F46 | 0.8 | 1.0 | 0.1 | 0.0 | 0.1 | 0.0 | 0.0 | Zn:0.5 | balance | 545:8 h | 385 | 200:1 h | 30 | 30 s | 1.4 | 0.3 | 39 | 13.4 |
| F47 | 1.0 | 0.6 | 0.1 | 0.1 | 0.0 | 0.0 | Ti: 0.5 | Sn:0.2 | balance | 540:16 h | 405 | 200:1 h | 17 | 30 s | 1.8 | 0.1 | 41 | 13.5 |
| F48 | 1.0 | 0.6 | 0.1 | 0.1 | 0.0 | 0.0 | V: 0.1 | Sn:0.1 | balance | 540:16 h | 400 | 200:1 h | 17 | 30 s | 1.8 | 0.1 | 41 | 13.6 |
| F49 | 0.6 | 1.2 | 0.2 | 0.1 | 0.0 | 0.0 | 0.0 | Cu:1.1 | balance | 550:4 h | 410 | 200:1 h | 17 | 30 s | 2.0 | 0.2 | 41 | 12.9 |
| F50 | 0.6 | 1.2 | 0.2 | 0.1 | 0.0 | 0.0 | 0.0 | Ag:0.3 | balance | 550:4 h | 415 | 400:1 h | 17 | 30 s | 1.1 | 0.3 | 39 | 12.8 |
| F51 | 0.6 | 1.2 | 0.2 | 0.1 | 0.0 | 0.0 | 0.0 | Zn:1.1 | balance | 550:4 h | 410 | 200:1 h | 30 | 30 s | 0.9 | 0.2 | 35 | 12.9 |
| F52 | 0.6 | 1.2 | 0.2 | 0.1 | 0.0 | 0.0 | 0.0 | Sn:0.3 | balance | 550:4 h | 400 | 200:1 h | 17 | 30 s | 1.8 | 0.1 | 39 | 13.0 |
| F53 | 0.6 | 1.2 | 1.1 | 0.1 | 0.0 | 0.0 | 0.0 | Cu:0.5 | balance | 550:4 h | 400 | 200:1 h | 17 | 30 s | 1.7 | 0.2 | 43 | 13.1 |
| F54 | 0.6 | 1.6 | 0.2 | 0.1 | 0.0 | 0.0 | 0.0 | Ag:0.2 Sn:0.1 | balance | 550:4 h | 390 | 400:1 h | 30 | 30 s | 1.3 | 0.4 | 44 | 12.9 |
| F55 | 1.6 | 1.2 | 0.2 | 0.1 | 0.0 | 0.0 | 0.0 | Zn:0.5 | balance | 550:4 h | 405 | 400:1 h | 30 | 30 s | 0.8 | 0.4 | 57 | 12.7 |

As shown from Table 3, the alloys (F41–48) comprising the composition having at least one of Mn, Fe, Cr, Zr, V and Ti and the GP promoting element within given ranges, having a ratio of the S/Cube and a ratio of the Goss/Cube within ranges of the present invention, and having a grain size of 80 μm or less had a drawing height of 13.4 mm or more and were excellent in deep-drawing formability.

[Al—Mg—Si based alloys excellent in stretch-formability]

EXAMPLE 4

Using base alloys (to which H1, H2, H9 and H10 in Table 4 correspond), Mn added alloys (to which H3–5, and H11–13 in Table 4 correspond) and Fe added alloys (to which H6–8 and H14–16 in Table 4 correspond), sheet materials having a thickness of 500 mm were produced by casting, and then were subjected to heating treatment for homogenization shown in Table 1.

The resultants were subjected to rough hot rolling from heating treatment temperature for the homogenization, to prepare sheet materials having a thickness of 30 mm. Subsequently, they were subjected to finishing hot rolling to prepare sheet materials having a thickness of 10–1.5 mm. The sheet materials were then subjected to cold rolling to prepare sheet materials having a thickness of 1 mm. The sheet materials having a thickness of 1 mm, which were obtained by the cold rolling, were subjected to solution heat treatment held at 550° C. for a given time to obtain sheet materials H1–16 having texture and grain sizes shown in Table 4.

In a series of the above-mentioned producing steps, finishing rolling starting temperature, cold rolling reduction, and conditions for the solution heat treatment were changed as shown in Table 4 so that texture and grain size were changed. Final cold rolling reduction was changed by changing the thickness of the sheet materials obtained by the finishing hot rolling. About the conditions for the solution heat treatment, the manner of heating up to the solution heat treating temperature (550° C.) and holding time were changed as shown in Table 4. In the table, the wording "Rapid" means rapid heating (1000° C./min.) and the wording "2 steps" means slow heating (40° C./h.) till 300° C., held at 300° C. for 1 hour, and rapid heating (1000° C./min.) till 550° C. After the solution heat treatment, annealing was performed in water.

About the texture, Cube orientation density, RW orientation density, CR orientation density, Brass orientation density, Goss orientation density, PP orientation density, C orientation density, and S orientation density thereof were measured to calculate X values.

H1–H16 were subjected to a stretch forming test, to measure critical height to cracking. The measured results are shown in Table 4, together with producing processes (final cold rolling reduction, temperature for the solution heat treatment and holding time, and heating rate), grain size and texture.

TABLE 4

| | Alloy composition (%) | | | | | Manufacturing process conditions | | | | | | |
|---|---|---|---|---|---|---|---|---|---|---|---|---|
| No. | Mg | Si | Mn | Fe | Al | Homogenizing treatment | Finishing start (° C.) | Final cold rolling reduction (%) | Solution heat treatment (holding time) | Texture X value | Grain size (μm) | Critical height to cracking (mm) |
| H1 | 0.6 | 1.2 | 0 | 0 | balance | 540:8 h | 380 | 70 | Rapid 30 s | 3.3 | 80 | 30.5 |
| H2 | 0.6 | 1.2 | 0 | 0 | balance | 540:8 h | 390 | 90 | Rapid 30 s | 2.9 | 76 | 30.1 |
| H3 | 0.6 | 1.2 | 0.2 | 0 | balance | 545:16 h | 300 | 33 | Rapid 30 s | 2.7 | 62 | 29.5 |
| H4 | 0.6 | 1.2 | 0.2 | 0 | balance | 545:16 h | 390 | 70 | 2 steps 30 s | 5.0 | 75 | 31.5 |
| H5 | 0.6 | 1.2 | 0.2 | 0 | balance | 545:16 h | 410 | 90 | 2 steps 40 s | 3.8 | 71 | 31.0 |
| H6 | 0.6 | 1.2 | 0 | 0.2 | balance | 550:24 h | 350 | 50 | 2 steps 40 s | 3.2 | 68 | 30.2 |
| H7 | 0.6 | 1.2 | 0 | 0.2 | balance | 550:24 h | 400 | 70 | Rapid 30 s | 2.9 | 54 | 29.8 |
| H8 | 0.6 | 1.2 | 0 | 0.2 | balance | 550:24 h | 430 | 90 | Rapid 30 s | 2.4 | 43 | 29.6 |
| H9 | 0.6 | 1.2 | 0 | 0 | balance | 540:8 h | 400 | 33 | Rapid 30 s | −0.5 | 121 | 27.5 |
| H10 | 0.6 | 1.2 | 0 | 0 | balance | 540:8 h | 400 | 33 | Rapid 30 s | −0.7 | 94 | 26.8 |
| H11 | 0.6 | 1.2 | 0.2 | 0 | balance | 545:16 h | 480 | 70 | Rapid 30 s | −0.4 | 30 | 27.1 |
| H12 | 0.6 | 1.2 | 0.2 | 0 | balance | 545:16 h | 490 | 90 | Rapid 30 s | −1.3 | 42 | 25.5 |
| H13 | 0.6 | 1.2 | 0.2 | 0 | balance | 545:16 h | 450 | 33 | Rapid 1 h | −2.6 | 86 | 24.9 |
| H14 | 0.6 | 1.2 | 0 | 0.2 | balance | 550:24 h | 440 | 50 | Rapid 30 s | −3.1 | 61 | 24.0 |
| H15 | 0.6 | 1.2 | 0 | 0.2 | balance | 550:24 h | 460 | 70 | Rapid 1 h | −1.8 | 107 | 25.4 |
| H16 | 0.6 | 1.2 | 0 | 0.2 | balance | 550:24 h | 470 | 90 | 2 steps 30 s | −0.7 | 161 | 26.2 |

As shown from Table 4, when the X value was 0 or more, the critical height to cracking was over 27.5 mm, and when the X value was less than 0, the critical height to cracking became small, i.e., 27.5 mm or less. When the X value was 2.4 or more, the critical height to cracking could be made to 29.5 mm or more.

EXAMPLE 5

The same way as in Example 1 was performed except that manufacturing process conditions (conditions for the homogenizing treatment, finishing hot rolling starting temperature, final cold rolling reduction, and conditions for the solution heat treatment) were changed as shown in Table 5 about Al—Mg—Si based alloys having the compositions shown in Table 5 (Al—Mg—Si based alloys H21 and 31, and Al—Mg—Si based alloys H22–30 and 32–38 comprising at least one of Mn, Fe, Cr, Zr, V and Ti). Thus, alloy sheets H21–38 having texture and grain sizes as shown in Table 5 were obtained.

The resultant alloy sheets were subjected to a $LDH_0$ test.

The test results are shown in Table 5, together with the alloy compositions, the producing conditions, the texture and grain sizes.

TABLE 5

| | Alloy composition (%) | | | | | | | | | Manufacturing process conditions | | | | | | |
|---|---|---|---|---|---|---|---|---|---|---|---|---|---|---|---|---|
| No. | Mg | Si | Mn | Fe | Cr | Zr | V | Ti | Al | Homogenizing treatment | Finishing start (° C.) | Final cold rolling reduction (%) | Solution heat treatment | Texture X value | Grain size (μm) | Critical height to cracking (mm) |
| H21 | 1.5 | 1.5 | 0.0 | 0.0 | 0.0 | 0.0 | 0.0 | 0.0 | balance | 550:8 h | 370 | 70 | Rapid 30 s | 3.2 | 72 | 30.3 |
| H22 | 1.0 | 0.6 | 0.0 | 0.0 | 0.0 | 0.0 | 0.0 | 0.03 | balance | 530:8 h | 380 | 70 | Rapid 30 s | 3.6 | 77 | 30.6 |
| H23 | 0.3 | 0.2 | 0.0 | 0.0 | 0.0 | 0.0 | 0.0 | 0.10 | balance | 535:24 h | 400 | 90 | Rapid 30 s | 2.9 | 80 | 30.0 |
| H24 | 0.6 | 1.2 | 0.2 | 0.1 | 0.0 | 0.05 | 0.0 | 0.0 | balance | 560:24 h | 300 | 33 | Rapid 30 s | 2.9 | 55 | 29.7 |
| H25 | 0.6 | 1.2 | 0.0 | 0.1 | 0.3 | 0.0 | 0.05 | 0.0 | balance | 555:16 h | 420 | 90 | 2 steps 30 s | 4.2 | 58 | 31.1 |
| H26 | 0.6 | 1.2 | 0.0 | 0.1 | 0.0 | 0.3 | 0.0 | 0.0 | balance | 550:12 h | 410 | 90 | 2 steps 30 s | 3.5 | 63 | 30.8 |
| H27 | 0.6 | 1.2 | 0.0 | 0.1 | 0.0 | 0.0 | 0.3 | 0.0 | balance | 560:24 h | 390 | 90 | 2 steps 30 s | 4.2 | 62 | 31.5 |
| H28 | 0.6 | 1.2 | 0.0 | 1.0 | 0.0 | 0.0 | 0.0 | 0.0 | balance | 550:8 h | 380 | 90 | Rapid 30 s | 3.4 | 48 | 30.2 |
| H29 | 0.6 | 1.2 | 1.0 | 0.0 | 0.0 | 0.0 | 0.0 | 0.0 | balance | 555:24 h | 390 | 70 | 2 steps 30 s | 2.9 | 43 | 29.9 |
| H30 | 0.6 | 1.2 | 0.1 | 0.1 | 0.1 | 0.0 | 0.0 | 0.0 | balance | 545:24 h | 380 | 70 | 2 steps 30 s | 2.7 | 47 | 29.8 |
| H31 | 1.6 | 1.0 | 0.0 | 0.0 | 0.0 | 0.0 | 0.0 | 0.0 | balance | 550:4 h | 450 | 70 | Rapid 30 s | −0.1 | 78 | 27.2 |
| H32 | 1.0 | 1.6 | 0.0 | 0.0 | 0.0 | 0.0 | 0.0 | 0.0 | balance | 550:4 h | 470 | 70 | Rapid 30 s | −0.2 | 75 | 27.0 |
| H33 | 0.6 | 1.2 | 1.1 | 0.0 | 0.0 | 0.0 | 0.0 | 0.0 | balance | 550:4 h | 470 | 33 | Rapid 30 s | −0.6 | 51 | 26.6 |
| H34 | 0.6 | 1.2 | 0.0 | 1.1 | 0.0 | 0.0 | 0.0 | 0.0 | balance | 550:4 h | 430 | 50 | 2 steps 30 s | −1.3 | 49 | 25.8 |
| H35 | 0.6 | 1.2 | 0.0 | 0.0 | 0.4 | 0.0 | 0.0 | 0.0 | balance | 550:4 h | 420 | 40 | 2 steps 30 s | −0.2 | 50 | 27.1 |
| H36 | 0.6 | 1.2 | 0.0 | 0.0 | 0.0 | 0.4 | 0.0 | 0.0 | balance | 550:4 h | 430 | 40 | 2 steps 30 s | −2.6 | 46 | 24.8 |
| H37 | 0.6 | 1.2 | 0.0 | 0.0 | 0.0 | 0.0 | 0.4 | 0.0 | balance | 550:4 h | 440 | 40 | 2 steps 30 s | −2.6 | 43 | 24.4 |
| H38 | 0.6 | 1.2 | 0.0 | 0.0 | 0.0 | 0.0 | 0.0 | 0.15 | balance | 550:4 h | 410 | 40 | 2 steps 30 s | −1.8 | 56 | 25.6 |

As shown from Table 5, when the X value was 0 or more, the critical height to cracking was over 27.5 mm, and when the X value was less than 0, the critical height to cracking became small, i.e., 27.5 mm or less. When the X value was 2.4 or more, the critical height to cracking could be made to 29.5 mm or more.

EXAMPLE 6

The same way as in Example 4 was performed except that manufacturing process conditions (conditions for the homogenizing treatment, finishing hot rolling starting temperature, final cold rolling reduction, and conditions for the solution heat treatment) were changed as shown in Table 6 about Al—Mg—Si based alloys having the compositions shown in Table 6 (Al—Mg—Si based alloys comprising at least one of Mn, Fe, Cr, Zr, V and Ti and comprising a GP promoting element (at least one of Cu, Ag, Zn and Sn)). Thus, alloy sheets H41–55 having texture and grain sizes as shown in Table 6 were obtained.

The resultant alloy sheets were subjected to a $LDH_0$ test.

The test results are shown in Table 6, together with the alloy compositions, the producing conditions, the texture and grain sizes.

The resultants were subjected to rough hot rolling from heating treatment temperature for the homogenization, to prepare sheet materials having a thickness of 30 mm. Subsequently, they were subjected to finishing hot rolling to prepare sheet materials having a thickness of 10–1.5 mm. The sheet materials were then subjected to cold rolling to prepare sheet materials having a thickness of 1 mm. The sheet materials having a thickness of 1 mm, which were obtained by the cold rolling, were subjected to solution heat treatment held at $_{550}$° C. for a given time to obtain sheet materials M1–16 having texture and grain sizes shown in Table 7.

In a series of the above-mentioned producing steps, finishing rolling starting temperature, cold rolling reduction, and conditions for the solution heat treatment were changed as shown in Table 7 so that texture and grain size were changed. Final cold rolling reduction was changed by changing the thickness of the sheet materials obtained by the finishing hot rolling. About the conditions for the solution heat treatment, the manner of heating up to the solution heat treating temperature (550° C.) and holding time were changed as shown in Table 7. In the table, the wording "Rapid" means rapid heating (1000° C./min.) and the wording "2 steps" means slow heating (40° C./h.) till 300° C., held at 300° C. for 1 hour, and rapid heating (1000° C./min.) till 500°C. After the solution heat treatment, annealing was performed in water.

TABLE 6

| | Alloy composition (%) | | | | | | | | | Manufacturing process conditions | | | | | | |
|---|---|---|---|---|---|---|---|---|---|---|---|---|---|---|---|---|
| No. | Mg | Si | Mn | Fe | Cr | Zr | Ti, V | GP promoting element | Al | Homogenizing treatment | Finishing start (° C.) | Final cold rolling reduction (%) | Solution heat treatment | Texture X value | Grain size (μm) | Critical height to cracking (mm) |
| H41 | 0.6 | 1.2 | 0.2 | 0.1 | 0.0 | 0.0 | 0.0 | Cu:1.0 | balance | 530:12 h | 380 | 80 | Rapid 30 s | 3.6 | 41 | 30.4 |
| H42 | 0.6 | 1.2 | 0.2 | 0.1 | 0.0 | 0.0 | 0.0 | Cu:0.5 | balance | 530:12 h | 400 | 80 | Rapid 30 s | 3.1 | 43 | 30.1 |
| H43 | 0.6 | 1.2 | 0.0 | 0.1 | 0.0 | 0.1 | 0.0 | Ag:0.2 | balance | 550:24 h | 350 | 70 | 2 steps 30 s | 2.7 | 52 | 29.7 |
| H44 | 0.6 | 1.2 | 0.0 | 0.1 | 0.0 | 0.1 | 0.0 | Ag:0.1 | balance | 550:24 h | 360 | 70 | 2 steps 30 s | 2.8 | 56 | 29.9 |
| H45 | 0.8 | 1.0 | 0.1 | 0.0 | 0.1 | 0.0 | 0.0 | Zn:1.0 | balance | 545:8 h | 420 | 90 | 2 steps 30 s | 4.3 | 50 | 31.1 |
| H46 | 0.8 | 1.0 | 0.1 | 0.0 | 0.1 | 0.0 | 0.0 | Zn:0.5 | balance | 545:8 h | 410 | 90 | 2 steps 30 s | 4.0 | 53 | 30.7 |
| H47 | 1.0 | 0.6 | 0.1 | 0.1 | 0.0 | 0.0 | Ti: 0.05 | Sn:0.2 | balance | 540:16 h | 300 | 50 | 2 steps 30 s | 3.6 | 48 | 30.5 |
| H48 | 1.0 | 0.6 | 0.1 | 0.1 | 0.0 | 0.0 | V: 0.10 | Sn:0.1 | balance | 540:16 h | 320 | 50 | 2 steps 30 s | 3.2 | 48 | 30.3 |
| H49 | 0.6 | 1.2 | 0.2 | 0.1 | 0.0 | 0.0 | 0.0 | Cu:1.1 | balance | 550:4 h | 450 | 33 | Rapid 30 s | −3.5 | 47 | 24.1 |
| H50 | 0.6 | 1.2 | 0.2 | 0.1 | 0.0 | 0.0 | 0.0 | Ag:0.3 | balance | 550:4 h | 470 | 60 | 2 steps 30 s | −2.0 | 51 | 25.0 |
| H51 | 0.6 | 1.2 | 0.2 | 0.1 | 0.0 | 0.0 | 0.0 | Zn:1.1 | balance | 550:4 h | 440 | 60 | 2 steps 30 s | −3.5 | 51 | 23.9 |
| H52 | 0.6 | 1.2 | 0.2 | 0.1 | 0.0 | 0.0 | 0.0 | Sn:0.3 | balance | 550:4 h | 450 | 50 | 2 steps 30 s | −1.6 | 50 | 25.7 |
| H53 | 0.6 | 1.2 | 1.1 | 0.0 | 0.0 | 0.0 | 0.0 | Cu:0.5 | balance | 550:4 h | 480 | 33 | Rapid 30 s | −2.2 | 51 | 25.1 |
| H54 | 0.6 | 1.6 | 0.2 | 0.1 | 0.0 | 0.0 | 0.0 | Ag:0.2 Sn:0.1 | balance | 550:4 h | 475 | 50 | Rapid 30 s | −2.8 | 77 | 24.4 |
| H55 | 1.6 | 1.2 | 0.2 | 0.1 | 0.0 | 0.0 | 0.0 | Zn:0.5 | balance | 550:4 h | 460 | 50 | Rapid 30 s | −3.6 | 71 | 24.0 |

As shown from Table 6, when the X value was 0 or more, the critical height to cracking was over 27.5 mm, and when the X value was less than 0, the critical height to cracking became small, i.e., 27.5 mm or less. When the X value was 2.4 or more, the critical height to cracking could be made to 29.5 mm or more.

[Al—Mg—Si based alloys excellent in bendability]

EXAMPLE 7

Using base alloys (to which M1, M2, M9 and M10 in Table 7 correspond), Mn added alloys (to which M3–5, and M11–13 in Table 7 correspond) and Fe added alloys (to which M6–8 and M14–16 in Table 7 correspond), sheet materials having a thickness of 500 mm were produced by casting, and then were subjected to heating treatment for homogenization shown in Table 7.

About the texture, Cube orientation density, RW orientation density, CR orientation density, Brass orientation density, Goss orientation density, PP orientation density, C orientation density, and S orientation density thereof were measured to calculate Y values.

M1–16 were subjected to a stretch forming test, to measure critical height to cracking. The measured results are shown in Table 7, together with manufacturing processes (final cold rolling reduction, temperature for the solution heat treatment and holding time, and heating rate), grain size and texture.

TABLE 7

| | Alloy composition (%) | | | | | Manufacturing process conditions | | | | | | |
|---|---|---|---|---|---|---|---|---|---|---|---|---|
| No. | Mg | Si | Mn | Fe | Al | Homogenizing treatment | Finishing start (° C.) | Final cold rolling reduction (%) | Solution heat treatment | Texture Y value | Grain size (μm) | Bendability |
| M1 | 0.6 | 1.2 | 0 | 0 | balance | 540:8 h | 420 | 90 | Rapid 30 s | 11.0 | 80 | ○ |
| M2 | 0.6 | 1.2 | 0 | 0 | balance | 540:8 h | 430 | 80 | Rapid 60 s | 10.7 | 66 | ○ |
| M3 | 0.6 | 1.2 | 0.2 | 0 | balance | 545:16 h | 440 | 90 | Rapid 30 s | 10.2 | 52 | ○ |
| M4 | 0.6 | 1.2 | 0.2 | 0 | balance | 545:16 h | 450 | 80 | Rapid 20 s | 10.2 | 65 | ○ |
| M5 | 0.6 | 1.2 | 0.2 | 0 | balance | 545:16 h | 440 | 75 | 2 steps 40 s | 10.1 | 61 | ○ |
| M6 | 0.6 | 1.2 | 0 | 0.2 | balance | 550:24 h | 425 | 90 | 2 steps 30 s | 10.4 | 58 | ○ |
| M7 | 0.6 | 1.2 | 0 | 0.2 | balance | 550:24 h | 425 | 80 | Rapid 30 s | 10.5 | 44 | ○ |
| M8 | 0.6 | 1.2 | 0 | 0.2 | balance | 550:24 h | 430 | 75 | Rapid 30 s | 9.8 | 33 | ○ |
| M9 | 0.6 | 1.2 | 0 | 0 | balance | 540:8 h | 380 | 50 | Rapid 30 s | 11.3 | 111 | x |
| M10 | 0.6 | 1.2 | 0 | 0 | balance | 540:8 h | 390 | 60 | Rapid 30 s | 11.5 | 84 | x |
| M11 | 0.6 | 1.2 | 0.2 | 0 | balance | 545:16 h | 350 | 33 | Rapid 30 s | 11.8 | 90 | x |
| M12 | 0.6 | 1.2 | 0.2 | 0 | balance | 545:16 h | 360 | 50 | Rapid 30 s | 11.4 | 42 | x |
| M13 | 0.6 | 1.2 | 0.2 | 0 | balance | 545:16 h | 380 | 70 | Rapid 1 h | 11.7 | 86 | x |
| M14 | 0.6 | 1.2 | 0 | 0.2 | balance | 550:24 h | 330 | 33 | Rapid 30 s | 11.9 | 51 | x |
| M15 | 0.6 | 1.2 | 0 | 0.2 | balance | 550:24 h | 370 | 50 | Rapid 1 h | 12.0 | 97 | x |
| M16 | 0.6 | 1.2 | 0 | 0.2 | balance | 550:24 h | 360 | 70 | 2 steps 1 h | 12.2 | 151 | x |

As shown from Table 7, when the Y value was 11.0 or less, bendability was good and when the Y value was over 11.0, bendability was poor.

EXAMPLE 8

The same way as in Example 7 was performed except that manufacturing process conditions (conditions for the homogenizing treatment, finishing hot rolling starting temperature, final cold rolling reductions, and conditions for the solution heat treatment) were changed as shown in Table 8 about Al—Mg—Si based alloys having the compositions shown in Table 8 (Al—Mg—Si based alloys M21 and 31, and Al—Mg—Si based alloys M22–30 and M32–38 comprising at least one of Mn, Fe, Cr, Zr, V and Ti). Thus, alloy sheets M21–38having texture and grain sizes as shown in Table 8 were obtained.

The resultant alloy sheets were subjected to a bending test.

The test results are shown in Table 8, together with the alloy compositions, the manufacturing process conditions, the texture and grain sizes.

TABLE 8

| | Alloy composition (%) | | | | | | | | | Manufacturing process conditions | | | | | | |
|---|---|---|---|---|---|---|---|---|---|---|---|---|---|---|---|---|
| No. | Mg | Si | Mn | Fe | Cr | Zr | V | Ti | Al | Homogenizing treatment | Finishing start (° C.) | Final cold rolling reduction (%) | Solution heat treatment | Texture Y value | Grain size (μm) | Bendability |
| M21 | 1.5 | 1.5 | 0.0 | 0.0 | 0.0 | 0.0 | 0.0 | 0.0 | balance | 550:8 h | 420 | 90 | Rapid 30 s | 10.8 | 62 | ○ |
| M22 | 1.0 | 0.6 | 0.0 | 0.0 | 0.0 | 0.0 | 0.0 | 0.03 | balance | 530:8 h | 420 | 80 | Rapid 30 s | 10.7 | 67 | ○ |
| M23 | 0.3 | 0.2 | 0.0 | 0.0 | 0.0 | 0.0 | 0.0 | 0.10 | balance | 535:24 h | 440 | 90 | Rapid 30 s | 11.0 | 70 | ○ |
| M24 | 0.6 | 1.2 | 0.2 | 0.1 | 0.0 | 0.05 | 0.0 | 0.0 | balance | 560:24 h | 450 | 80 | Rapid 30 s | 10.3 | 80 | ○ |
| M25 | 0.6 | 1.2 | 0.0 | 0.1 | 0.3 | 0 | 0.05 | 0.0 | balance | 555:16 h | 440 | 75 | 2 steps 30 s | 10.1 | 58 | ○ |
| M26 | 0.6 | 1.2 | 0.0 | 0.1 | 0.0 | 0.3 | 0.0 | 0.0 | balance | 550:12 h | 435 | 80 | 2 steps 30 s | 10.5 | 53 | ○ |
| M27 | 0.6 | 1.2 | 0.0 | 0.1 | 0.0 | 0.0 | 0.0 | 0.0 | balance | 560:24 h | 425 | 90 | 2 steps 30 s | 10.5 | 52 | ○ |
| M28 | 0.6 | 1.2 | 0.0 | 1.0 | 0.0 | 0.0 | 0.3 | 0.0 | balance | 550:8 h | 430 | 90 | Rapid 30 s | 10.4 | 48 | ○ |
| M29 | 0.6 | 1.2 | 1.0 | 0.0 | 0.0 | 0.0 | 0.0 | 0.0 | balance | 555:24 h | 425 | 75 | 2 steps 20 s | 10.8 | 43 | ○ |
| M30 | 0.6 | 1.2 | 0.1 | 0.1 | 0.1 | 0.0 | 0.0 | 0.0 | balance | 545:24 h | 450 | 90 | 2 steps 20 s | 10.0 | 37 | ○ |
| M31 | 1.6 | 1.0 | 0.0 | 0.0 | 0.0 | 0.0 | 0.0 | 0.0 | balance | 550:4 h | 370 | 50 | Rapid 30 s | 11.6 | 68 | x |
| M32 | 1.0 | 1.6 | 0.0 | 0.0 | 0.0 | 0.0 | 0.0 | 0.0 | balance | 550:4 h | 365 | 55 | Rapid 30 s | 11.4 | 65 | x |
| M33 | 0.6 | 1.2 | 1.1 | 0.0 | 0.0 | 0.0 | 0.0 | 0.0 | balance | 550:4 h | 380 | 60 | Rapid 30 s | 11.2 | 51 | x |
| M34 | 0.6 | 1.2 | 0.0 | 1.1 | 0.0 | 0.0 | 0.0 | 0.0 | balance | 550:4 h | 370 | 33 | 2 steps 30 s | 11.9 | 39 | x |
| M35 | 0.6 | 1.2 | 0.0 | 0.0 | 0.4 | 0.0 | 0.0 | 0.0 | balance | 550:4 h | 375 | 50 | 2 steps 30 s | 11.7 | 40 | x |
| M36 | 0.6 | 1.2 | 0.0 | 0.0 | 0.0 | 0.4 | 0.0 | 0.0 | balance | 550:4 h | 375 | 40 | 2 steps 30 s | 11.5 | 46 | x |
| M37 | 0.6 | 1.2 | 0.0 | 0.0 | 0.0 | 0.0 | 0.4 | 0.0 | balance | 550:4 h | 350 | 33 | 2 steps 30 s | 11.5 | 36 | x |
| M38 | 0.6 | 1.2 | 0.0 | 0.0 | 0.0 | 0.0 | 0.0 | 0.15 | balance | 550:4 h | 340 | 60 | 2 steps 30 s | 11.1 | 46 | x |

As shown from Table 8, when the Y value was 11.0 or less, bendability was good and when the Y value was over 11.0, bendability was poor.

EXAMPLE 9

The same way as in Example 7 was performed except that manufacturing process conditions (conditions for the homogenizing treatment, finishing hot rolling starting temperature, final cold rolling reduction, and conditions for the solution heat treatment) were changed as shown in Table 9 about Al—Mg—Si based alloys having the compositions shown in Table 9 (Al—Mg—Si based alloys comprising at least one of Mn, Fe, Cr, Zr, V and Ti and comprising a GP promoting element (at least one of Cu, Ag, Zn and Sn)). Thus, alloy sheets M41–55 having texture and grain sizes as shown in Table 9 were obtained.

The resultant alloy sheets were subjected to a $LDH_0$ test.

The test results are shown in Table 9, together with the alloy compositions, the manufacturing process conditions, the texture and grain sizes.

About three portions: the surface of the sheet of the resultant T4 material, a portion inside ¼ of thickness from the surface thereof, and the central portion of the sheet along its thickness direction thereof, an X-ray diffraction device was used to measure (100), (110) and (111) perfect pole figures. Orientation densities of respective orientations in the respective portions were calculated from them, using a crystallite orientation distribution function. They were averaged to obtain the orientation density of the whole of the sheet material. Thus, the above-mentioned X value was obtained.

In order to evaluate stretch-formability, a lubricant was applied to a test piece 180 mm long and 110 mm wide and

TABLE 9

| | Alloy composition (%) | | | | | | | | | Manufacturing process conditions | | | | | | |
|---|---|---|---|---|---|---|---|---|---|---|---|---|---|---|---|---|
| No. | Mg | Si | Mn | Fe | Cr | Zr | V, Ti | GP promoting element | Al | Homogenizing treatment | Finishing start (° C.) | Final cold rolling reduction (%) | Solution heat treatment | Texture Y value | Grain size (μm) | Bend-ability |
| M41 | 0.6 | 1.2 | 0.2 | 0.1 | 0 | 0.0 | 0.0 | Cu: 1.0 | balance | 530:12 h | 410 | 90 | Rapid 30 s | 10.7 | 42 | ○ |
| M42 | 0.6 | 1.2 | 0.2 | 0.1 | 0.0 | 0.0 | 0.0 | Cu: 0.5 | balance | 530:12 h | 415 | 90 | Rapid 30 s | 10.4 | 38 | ○ |
| M43 | 0.6 | 1.2 | 0.0 | 0.1 | 0.0 | 0.1 | 0.0 | Ag: 0.2 | balance | 550:24 h | 430 | 80 | 2 steps 20 s | 10.5 | 47 | ○ |
| M44 | 0.6 | 1.2 | 0.0 | 0.1 | 0.0 | 0.1 | 0.0 | Ag: 0.1 | balance | 550:24 h | 425 | 80 | 2 steps 20 s | 10.9 | 61 | ○ |
| M45 | 0.8 | 1.0 | 0.1 | 0.0 | 0.1 | 0.0 | 0.0 | Zn: 1.0 | balance | 545:8 h | 420 | 70 | 2 steps 30 s | 11.0 | 45 | ○ |
| M46 | 0.8 | 1.0 | 0.1 | 0.0 | 0.1 | 0.0 | 0.0 | Zn: 0.5 | balance | 545:8 h | 425 | 70 | 2 steps 30 s | 10.8 | 58 | ○ |
| M47 | 1.0 | 0.6 | 0.1 | 0.1 | 0.0 | 0.0 | Ti: 0.05 | Sn: 0.2 | balance | 540:16 h | 430 | 90 | 2 steps 30 s | 10.7 | 53 | ○ |
| M48 | 1.0 | 0.6 | 0.1 | 0.1 | 0.0 | 0.0 | V: 0.1 | Sn: 0.1 | balance | 540:16 h | 435 | 90 | 2 steps 30 s | 10.7 | 44 | ○ |
| M49 | 0.6 | 1.2 | 0.2 | 0.1 | 0.0 | 0.0 | 0.0 | Cu: 1.1 | balance | 550:4 h | 350 | 50 | Rapid 30 s | 11.2 | 46 | x |
| M50 | 0.6 | 1.2 | 0.2 | 0.1 | 0.0 | 0.0 | 0.0 | Ag: 0.3 | balance | 550:4 h | 345 | 50 | 2 steps 20 s | 11.5 | 52 | x |
| M51 | 0.6 | 1.2 | 0.2 | 0.1 | 0.0 | 0.0 | 0.0 | Zn: 1.1 | balance | 550:4 h | 330 | 45 | 2 steps 30 s | 11.3 | 48 | x |
| M52 | 0.6 | 1.2 | 0.2 | 0.1 | 0.0 | 0.0 | 0.0 | Sn: 0.3 | balance | 550:4 h | 360 | 33 | 2 steps 30 s | 11.6 | 55 | x |
| M53 | 0.6 | 1.2 | 1.1 | 0.0 | 0.0 | 0.0 | 0.0 | Cu: 0.5 | balance | 550:4 h | 370 | 50 | Rapid 30 s | 11.4 | 49 | x |
| M54 | 0.6 | 1.6 | 0.2 | 0.1 | 0.0 | 0.0 | 0.0 | Ag: 0.2 Sn: 0.1 | balance | 550:4 h | 370 | 55 | Rapid 30 s | 11.3 | 78 | x |
| M55 | 1.6 | 1.2 | 0.2 | 0.1 | 0.0 | 0.0 | 0.0 | Zn: 0.5 | balance | 550:4 h | 380 | 60 | Rapid 30 s | 11.5 | 76 | x |

As shown from Table 9, when the Y value was 11.0 or less, bendability was good and when the Y value was over 11.0, bendability was poor.

EXAMPLE 10

Using Al alloys having various compositions shown in Tables 10 and 11, ingots were produced by DC casting or thin plate continuos casting. The resultant ingots were subjected to homogenizing treatment at 540° C. for 8 hours, and then hot-rolled at various rolling reductions and finishing temperature shown in Tables 1 and 2. A part of the resultant sheet materials having various thicknesses was subjected to intermediate annealing and then was cold-rolled to prepare sheet materials having a thickness of 1 mm. Thereafter, the sheet materials were subjected to solution heat treatment and then annealing in water to obtain T4 materials. Tables 1 and 2 also show whether or not intermediate annealing was performed, cold rolling reduction, and the raising speed in temperature and holding temperature upon the solution heat treatment.

then a stretch forming test was performed at a forming rate of 4 mm/s and a blank holding force of 200 kN, using a spherical-head stretch forming tool having a diameter of 101.6 mm. Thus, a critical strain to cracking was measured. About the above-mentioned critical strain to cracking, transcription was performed in the manner that circles having a diameter of 6.0 mm were adjacent to the whole surface of the test piece before the stretch forming and then the following was measured: an increase in strain in the longitudinal direction of the circle wherein cracking was generated after the forming. It was defined as the critical strain to cracking.

[Critical strain to cracking]=([major axis of the ellipse wherein cracking was generated]−[diameter of the circle])/[diameter of the circle]×100

The results are shown in Tables 10 and 11.

TABLE 10

| | Composition (%) | | | | | | | | Hot rolling | | Inter- | Cold | Solution heat treatment | | | Critical |
|---|---|---|---|---|---|---|---|---|---|---|---|---|---|---|---|---|
| | | | | | | | | | Rolling reduction | Finishing temperature | mediate annealing | rolling reduction | Raising speed in temperature | Holding temperature | X | strain to cracking |
| No. | Mg | Si | Fe | Mn | Cr | Zr | V | Ti | (%) | (° C.) | (° C.) | (%) | (° C./S) | (° C.) | value | (%) |
| 1 | 0.5 | 1.0 | 0.3 | | | | | | 95 | 350 | Not done | 80 | 10 | 560 | 4.0 | 26.0 |
| 2 | 0.5 | 1.0 | 0.2 | | | | | 0.03 | 85 | 370 | Not done | 80 | 10 | 550 | 1.0 | 23.2 |
| 3 | 0.5 | 1.0 | 0.9 | | | | | 0.10 | 80 | 365 | Not done | 90 | 10 | 550 | 3.0 | 25.0 |
| 4 | 1.9 | 1.9 | 0.2 | | | | | | 95 | 375 | Not done | 75 | 10 | 560 | 2.5 | 24.0 |
| 5 | 0.3 | 0.2 | 0.2 | | | | | | 70 | 380 | Not done | 85 | 10 | 560 | 3.5 | 26.0 |
| 6 | 0.5 | 1.0 | 0.2 | 0.2 | | 0.3 | | | 90 | 365 | Not done | 80 | 10 | 560 | 3.2 | 25.4 |
| 7 | 0.5 | 1.0 | 0.2 | | 0.3 | | 0.05 | | 85 | 360 | Not done | 95 | 10 | 560 | 0.5 | 23.0 |
| 8 | 0.5 | 1.0 | 0.2 | | | 0.3 | | | 80 | 375 | Not done | 80 | 10 | 560 | 3.5 | 26.2 |
| 9 | 0.5 | 1.0 | 0.2 | 1.0 | | 0.05 | | | 85 | 300 | 400 | 85 | 10 | 560 | 2.0 | 23.6 |
| 10 | 0.5 | 1.0 | 0.2 | | 0.1 | | 0.3 | | 98 | 310 | 380 | 70 | 10 | 560 | 1.5 | 23.4 |
| 11 | 0.5 | 1.0 | 0.2 | | | | | | 50 | 330 | Not done | 60 | 10 | 550 | −1.0 | 20.0 |
| 12 | 2.1 | 2.2 | 0.6 | | | | | | 65 | 335 | Not done | 60 | 10 | 550 | −2.0 | 19.0 |
| 13 | 1.5 | 0.8 | 1.1 | | | | | | 90 | 310 | Not done | 70 | 10 | 560 | −1.5 | 19.5 |
| 14 | 0.5 | 1.0 | 0.2 | 1.1 | | | | | 80 | 295 | Not done | 45 | 50 | 550 | −0.5 | 20.5 |
| 15 | 0.5 | 1.0 | 0.2 | | 0.4 | | | | 70 | 330 | Not done | 50 | 10 | 450 | −3.0 | 18.6 |
| 16 | 0.5 | 1.0 | 0.3 | | | 0.4 | | | 50 | 300 | Not done | 40 | 50 | 550 | −3.5 | 18.2 |
| 17 | 0.5 | 1.0 | 0.3 | | | | 0.4 | | 60 | 315 | Not done | 60 | 10 | 550 | −2.0 | 19.2 |
| 18 | 0.5 | 1.0 | 0.2 | | | | | 0.03 | 95 | 310 | 500 | 60 | 10 | 550 | −1.5 | 19.6 |

TABLE 11

| | Composition (%) | | | | | | | | | | | Hot rolling | | Inter- | Cold | Solution heat treatment | | | Critical |
|---|---|---|---|---|---|---|---|---|---|---|---|---|---|---|---|---|---|---|---|
| | | | | | | | | | | | | Rolling reduction | Finishing temperature | mediate annealing | rolling reduction | Raising speed in temperature | Holding temperature | X | strain to cracking |
| No. | Mg | Si | Fe | Mn | Cr | Zr | Ti | Cu | Ag | Zn | Sn | (%) | (° C.) | (° C.) | (%) | (° C./S) | (° C.) | value | (%) |
| 19 | 0.5 | 1.0 | 0.3 | 0.2 | | | | 0.8 | | | | 80 | 360 | Not done | 85 | 10 | 560 | 4.5 | 25.5 |
| 20 | 0.5 | 1.0 | 0.2 | 0.2 | | | | 0.5 | | | | 90 | 375 | Not done | 90 | 10 | 550 | 2.0 | 23.8 |
| 21 | 0.5 | 1.0 | 0.3 | | | 0.1 | | | 0.2 | | | 95 | 365 | Not done | 80 | 10 | 550 | 1.5 | 23.4 |
| 22 | 0.5 | 1.0 | 0.3 | | | 0.1 | | | 0.1 | | | 85 | 380 | Not done | 95 | 10 | 560 | 2.5 | 24.5 |
| 23 | 0.7 | 0.9 | 0.2 | 0.1 | 0.1 | | | | | 1.0 | | 98 | 400 | Not done | 90 | 10 | 560 | 2.9 | 25.1 |
| 24 | 0.7 | 0.9 | 0.15 | 0.1 | 0.1 | | | | | 0.5 | | 90 | 370 | Not done | 75 | 10 | 540 | 1.0 | 23.2 |
| 25 | 0.9 | 0.5 | 0.2 | 0.1 | | | 0.05 | | | | 0.2 | 95 | 365 | Not done | 70 | 10 | 550 | 2.2 | 24.0 |
| 26 | 0.9 | 0.5 | 0.15 | 0.1 | | | 0.1 | | | | 0.1 | 85 | 380 | Not done | 80 | 10 | 560 | 3.0 | 26.0 |
| 27 | 0.5 | 1.0 | 0.3 | 0.2 | | | | 1.2 | | | | 70 | 340 | Not done | 60 | 10 | 550 | −1.0 | 20.1 |
| 28 | 0.5 | 1.0 | 0.3 | 0.2 | | | | | 0.3 | | | 90 | 315 | Not done | 65 | 10 | 560 | −0.4 | 20.7 |
| 29 | 0.5 | 1.0 | 0.2 | 0.2 | | | | | | 1.1 | | 60 | 320 | Not done | 50 | 10 | 550 | −1.5 | 19.5 |
| 30 | 0.5 | 1.0 | 0.2 | 0.2 | | | | | | | 0.3 | 85 | 310 | Not done | 60 | 10 | 550 | −2.0 | 18.9 |
| 31 | 0.5 | 1.0 | 0.3 | 1.1 | | | | 0.5 | | | | 80 | 335 | Not done | 55 | 10 | 540 | −2.5 | 18.7 |
| 32 | 0.5 | 1.5 | 0.3 | 0.5 | 0.2 | 0.2 | | 0.3 | 0.2 | 0.3 | | 75 | 330 | Not done | 65 | 10 | 560 | −0.5 | 20.4 |

Nos. 1–10 in Table 10 and Nos. 19–26 in Table 11 were Al—Mg—Si based alloy sheets according to the present invention. All of them had a large critical strain to cracking and were excellent in stretch-formability.

On the other hand, all of Nos. 11–18 in Table 10 and Nos. 27–32 in Table 11 were comparative examples whose X value was negative. They had a small critical strain to cracking, and were poor in stretch formability.

[Al—Mg—Si based alloy alloys excellent in actual press-formability]

EXAMPLE 11

Using Al alloys having various compositions shown in Tables 12 and 13, the same way as in Example 10 was performed except following producing conditions shown in Tables 12 and 13, so as to obtain test pieces.

Grain sizes were measured in each given area in the sheet thickness direction by the cross-cut method. Not less than 100 grains were cut, and average section length obtained therefrom was calculated as an average grain size.

Actual press-formability was evaluated as follows. Sliding friction (influx phenomenon) between a pressing mould and the test piece was caused, at the time of stretch forming, by changing the blank holding force to 50 kN in the stretch forming test performed in Example 10, and a critical height to cracking was measured.

The results are shown in Tables 12 and 13.

TABLE 12

| | Composition (%) | | | | | | | | Manufacturing process conditions | | | | | | | |
|---|---|---|---|---|---|---|---|---|---|---|---|---|---|---|---|---|
| No. | Mg | Si | Fe | Mn | Cr | Zr | V | Ti | Homogenizing treatment (° C./hr., sec.) | Finishing start temperature (° C.) | Rough annealing (° C./hr., sec.) | Final cold rolling reduction (%) | Solution heat treatment (° C./hr., sec.) | Cube orientation density | Grain size (μm) | Critical strain to cracking (mm) |
| 1 | 0.5 | 1.0 | 0.2 | | | | | | 480:12 hr | 400 | 500:90 s | 80 | 550:60 s | 8 | 30 | 30.2 |
| 2 | 0.5 | 1.0 | 0.2 | | | | | 0.03 | 510:6 hr | 460 | 450:2 hr | 85 | 550:60 s | 14 | 29 | 30.0 |
| 3 | 0.5 | 1.0 | 0.9 | | | | | 0.10 | 450:24 hr | 300 | 500:90 s | 70 | 550:60 s | 7 | 28 | 30.3 |
| 4 | 1.9 | 1.9 | 0.2 | | | | | | 530:4 hr | 490 | 500:90 s | 85 | 550:60 s | 15 | 27 | 30.4 |
| 5 | 0.3 | 0.2 | 0.2 | | | | | | 500:6 hr | 450 | 500:90 s | 80 | 550:60 s | 10 | 35 | 30.0 |
| 6 | 0.5 | 1.0 | 0.2 | 0.2 | | 0.3 | | | 540:6 hr | 510 | Not done | 65 | 550:60 s | 12 | 24 | 31.5 |
| 7 | 0.5 | 1.0 | 0.2 | | 0.3 | | 0.05 | | 420:24 hr | 320 | 400:2 hr | 80 | 550:60 s | 8 | 25 | 31.8 |
| 8 | 0.5 | 1.0 | 0.2 | | | 0.3 | | | 490:12 hr | 450 | 500:90 s | 75 | 550:60 s | 12 | 24 | 32.0 |
| 9 | 0.5 | 1.0 | 0.2 | 1.0 | | 0.05 | | | 520:6 hr | 480 | 500:90 s | 60 | 550:60 s | 10 | 25 | 31.5 |
| 10 | 0.5 | 1.0 | 0.2 | | 0.1 | | 0.3 | | 500:8 hr | 450 | 500:90 s | 60 | 550:60 s | 7 | 24 | 31.3 |
| 11 | 0.5 | 1.0 | 0.2 | 0.1 | | | | 0.02 | 510:6 hr | 440 | 300:3 hr | 85 | 550:60 s | 16 | 30 | 28.5 |
| 12 | 0.5 | 2.2 | 0.2 | 0.1 | | | | 0.02 | 500:4 hr | 450 | 400:2 hr | 45 | 550:60 s | 4 | 45 | 27.5 |

TABLE 13

| | Composition (%) | | | | | | | | | | | Manufacturing process conditions | | | | | | | |
|---|---|---|---|---|---|---|---|---|---|---|---|---|---|---|---|---|---|---|---|
| No. | Mg | Si | Fe | Mn | Cr | Zr | Ti | Cu | Ag | Zn | Sn | Homogenizing treatment (° C./hr., sec.) | Finishing start temperature (° C.) | Rough annealing (° C./hr., sec.) | Final cold rolling reduction (%) | Solution heat treatment (° C./hr., sec.) | Cube orientation density | Grain size (μm) | Critical strain to cracking (mm) |
| 13 | 0.5 | 1.0 | 0.3 | 0.2 | | | | 0.8 | | | | 480:12 hr | 400 | 500:60 s | 60 | 550:60 s | 10 | 28 | 30.5 |
| 14 | 0.5 | 1.0 | 0.2 | 0.2 | | | | 0.5 | | | | 510:6 hr | 460 | 450:2 hr | 75 | 550:60 s | 6 | 35 | 30.2 |
| 15 | 0.5 | 1.0 | 0.1 | | | 0.1 | | | 0.2 | | | 450:24 hr | 300 | 500:90 s | 65 | 550:60 s | 5 | 28 | 30.3 |
| 16 | 0.5 | 1.0 | 0.3 | | | 0.1 | | | 0.1 | | | 530:4 hr | 490 | 500:60 s | 75 | 550:60 s | 10 | 25 | 31.2 |
| 17 | 0.7 | 0.9 | 0.2 | 0.1 | 0.1 | | | | | 1.0 | | 500:6 hr | 450 | 450:2 hr | 80 | 550:60 s | 12 | 24 | 31.6 |
| 18 | 0.7 | 0.9 | 0.15 | 0.1 | 0.1 | | | | | 0.5 | | 540:6 hr | 510 | Not done | 70 | 550:60 s | 13 | 38 | 30.3 |
| 19 | 0.9 | 0.5 | 0.2 | 0.1 | | | 0.05 | | | | 0.2 | 420:24 hr | 320 | 500:90 s | 80 | 550:60 s | 14 | 25 | 31.5 |
| 20 | 0.9 | 0.5 | 0.15 | 0.1 | | | 0.1 | | | | 0.1 | 490:12 hr | 450 | 500:90 s | 75 | 550:60 s | 8 | 27 | 30.6 |
| 21 | 0.5 | 1.0 | 0.2 | 0.1 | | | 0.02 | 0.3 | | | | 500:8 hr | 450 | 300:2 hr | 65 | 550:60 s | 3 | 35 | 28.3 |
| 22 | 0.5 | 1.0 | 0.2 | 0.1 | | | 0.02 | 0.3 | | | | 520:12 hr | 460 | 350:2 hr | 55 | 550:60 s | 17 | 40 | 28.0 |

Nos. 1–10 in Table 12 and Nos. 13–20 in Table 13 were Al—Mg—Si based alloy sheets according to the present invention. All of them had a large critical height to cracking and were excellent in actual press-formability.

On the other hand, all of Nos. 11–12 in Table 12 and Nos. 21–22 in Table 13 were examples whose Cube orientation density was not within the range of 5–15. They had a small critical height to cracking, and were poor in actual press-formability.

Since the present invention has the above-mentioned structure, it has become possible to provide an Al—Mg—Si based alloy sheet excellent in press-formability such as deep-drawing formability, stretch-formability and bendability.

What is claimed is:

1. An Al—Mg—Si based alloy sheet comprising 0.1–1.5 wt % Mg, and 0.1–2.0 wt % Si, wherein the alloy sheet has a texture such that $X_1$ is 0 or more in the following equation:

$$X_1=0.02\{Cube\}-1.8\{RW\}+1.05\{CR\}-2.84\{Brass\}-0.22\{Goss\}-0.76\{PP\}-0.32\{C\}-1.49\{S\}+5.2,$$

where Cube orientation density, RW orientation density, CR orientation density, Brass orientation density, Goss orientation density, PP orientation density, C orientation density, and S orientation density are represented by {Cube}, {RW}, {CR}, {Brass}, {Goss}, {PP}, {C} and {S}, respectively.

2. The Al—Mg—Si based alloy sheet according to claim 1, where its grain size is 80 μm or less.

3. The Al—Mg—Si based alloy sheet according to claim 1, which further comprises, as alloy components, one or more selected from the group consisting of the following in a total amount of 0.01–1.5 wt %:

Fe: 1.0 wt % or less (not including 0 wt %),

Mn: 1.0 wt % or less (not including 0 wt %),

Cr: 0.3 wt % or less (not including 0 wt %),

Zr: 0.3 wt % or less (not including 0 wt %),

V: 0.3 wt % or less (not including 0 wt %), and

Ti: 0.1 wt % or less (not including 0 wt %).

4. The Al—Mg—Si based alloy sheet according to claim 3, which further comprises, as an alloy component, the following:

Sn: 0.2 wt % or less (not including 0 wt %).

5. The Al—Mg—Si based alloy sheet according to claim 3, which further comprises, as alloy components, one or more selected from the group consisting of the following in a total amount of 0.01–1.5 wt %:

Cu: 1.0 wt % or less (not including 0 wt %),

Ag: 0.2 wt % or less (not including 0 wt %), and

Zn: 1.0 wt % or less (not including 0 wt %).

6. The Al—Mg—Si based alloy sheet according to claim 5, which further comprises, as an alloy component, the following:

Sn: 0.2 wt % or less (not including 0 wt %).

7. The Al—Mg—Si based alloy sheet according to claim 1, which further comprises, as alloy components, one or more selected from the group consisting of the following in a total amount of 0.01–1.5 wt %:

Cu: 1.0 wt % or less (not including 0 wt %),

Ag: 0.2 wt % or less (not including 0 wt %), and

Zn: 1.0 wt % or less (not including 0 wt %).

8. Al—Mg—Si based alloy sheet according to claim 7, which further comprises, as an alloy component, the following:

Sn: 0.2 wt % or less (not including 0 wt %).

9. The Al—Mg—Si based alloy sheet according to claim 1, which further comprises, as an alloy component, the following:

Sn: 0.2 wt % or less (not including 0 wt %).

10. A method of making an Al—Mg—Si based alloy sheet, the method comprising rolling an Al—Mg—Si based alloy; and producing the Al—Mg—Si based alloy sheet of claim 1.

11. An Al—Mg—Si based alloy sheet comprising 0.1–1.5 wt % Mg, and 0.1–2.0 wt % Si, wherein the alloy sheet has a texture such that Y is 11 or less in the following equation:

$$Y=0.66\{Cube\}-1.98\{RW\}+2.26\{CR\}+4.48\{Brass\}-1.36\{Goss\}-1.17\{PP\}+1.67\{C\}+0.07\{S\},$$

where Cube orientation density, RW orientation density, CR orientation density, Brass orientation density, Goss orientation density, PP orientation density, C orientation density, and S orientation density are represented by {Cube}, {RW}, {CR}, {Brass}, {Goss}, {PP}, {C} and {S}, respectively.

12. The Al—Mg—Si based alloy sheet according to claim 11, wherein its grain size is 80 $\mu$m or less.

13. The Al—Mg—Si based alloy sheet according to claim 1, which further comprises, as alloy components, one or more selected from the group consisting of the following in a total amount of 0.01–1.5 wt %:

Fe: 1.0 wt % or less (not including 0 wt %),

Mn: 1.0 wt % or less (not including 0 wt %),

Cr: 0.3 wt % or less (not including 0 wt %),

Zr: 0.3 wt % or less (not including 0 wt %),

V: 0.3 wt % or less (not including 0 wt %), and

Ti: 0.1 wt % or less (not including 0 wt %).

14. The Al—Mg—Si based alloy sheet according to claim 13, which further comprises, as alloy components, one or more selected from the group consisting of the following in a total amount of 0.01–1.5 wt %:

Cu: 1.0 wt % or less (not including 0 wt %),

Ag: 0.2 wt % or less (not including 0 wt %), and

Zn: 1.0 wt % or less (not including 0 wt %).

15. The Al—Mg—Si based alloy sheet according to claim 14, which further comprises, as an alloy component, the following:

Sn: 0.2 wt % or less (not including 0 wt %).

16. The Al—Mg—Si based alloy sheet according to claim 13, which further comprises, as an alloy component, the following:

Sn: 0.2 wt % or less (not including 0 wt %).

17. The Al—Mg—Si based alloy sheet according to claim 11, which further comprises, as alloy components, one or more selected from the group consisting of the following in a total amount of 0.01–1.5 wt %:

Cu: 1.0 wt % or less (not including 0 wt %),

Ag: 0.2 wt % or less (not including 0 wt %), and

Zn: 1.0 wt % or less (not including 0 wt %).

18. Al—Mg—Si based alloy sheet according to claim 17, which further comprises, as an alloy component, the following:

Sn: 0.2 wt % or less (not including 0 wt %).

19. The Al—Mg—Si based alloy sheet according to claim 11, which further comprises, as an alloy component, the following:

Sn: 0.2 wt % or less (not including 0 wt %).

20. A method of making an Al—Mg—Si based alloy sheet, the method comprising rolling an Al—Mg—Si based alloy; and producing the Al—Mg—Si based alloy sheet of claim 11.

* * * * *